US008545347B2

(12) United States Patent
Molinari

(10) Patent No.: US 8,545,347 B2
(45) Date of Patent: Oct. 1, 2013

(54) GOLF BALL WITH ORIENTED PARTICLES

(75) Inventor: Arthur Molinari, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 942 days.

(21) Appl. No.: 12/490,087

(22) Filed: Jun. 23, 2009

(65) Prior Publication Data

US 2010/0323817 A1 Dec. 23, 2010

(51) Int. Cl.
*A63B 37/06* (2006.01)

(52) U.S. Cl.
USPC ..... 473/378

(58) Field of Classification Search
USPC ..... 473/378, 351
See application file for complete search history.

(56) References Cited

U.S. PATENT DOCUMENTS

| | | | |
|---|---|---|---|
| 5,766,097 | A | 6/1998 | Horiuchi et al. |
| 5,967,906 | A | 10/1999 | Horiuchi et al. |
| 6,193,617 | B1 | 2/2001 | Mertens |
| 6,794,447 | B1 | 9/2004 | Kim et al. |
| 7,384,352 | B2 | 6/2008 | Ohama et al. |
| 7,396,301 | B2 | 7/2008 | Ohama et al. |
| 7,410,430 | B2 | 8/2008 | Isogawa et al. |
| 2005/0233835 | A1 | 10/2005 | Nesbitt |
| 2007/0049421 | A1 | 3/2007 | Ohama et al. |
| 2008/0039236 | A1 | 2/2008 | Isogawa et al. |
| 2008/0254913 | A1 | 10/2008 | Morgan |
| 2009/0054175 | A1 | 2/2009 | Isogawa et al. |
| 2009/0054176 | A1 | 2/2009 | Isogawa et al. |
| 2009/0082137 | A1 | 3/2009 | Okabe |

FOREIGN PATENT DOCUMENTS

| | | |
|---|---|---|
| AU | 2010100629 | 7/2010 |
| CN | 201020001512.7 | 4/2011 |
| EP | 2266670 | 9/2012 |
| JP | 4341134 | 11/1992 |
| JP | 2006-75210 | 3/2006 |
| JP | 4368338 | 2/2007 |
| JP | 2007-054432 | 3/2007 |
| KR | 10-1998-0070080 | 10/1998 |

OTHER PUBLICATIONS

Extended European Search Report for European Patent Application No. 09178133.6, mailed Mar. 31, 2010.
Prior Art Search Report for Korean Patent Application No. 10-2009-0112598 submitted to Korean intellectual Property Office on Jan. 5, 2010.
Certificate of Examination in Australian Innovation Patent No. 2010100629, signed on Jan. 25, 2011.
Notice of Allowance in Canadian Patent Application No. 2,686,422, mailed on Nov. 22, 2012.
Decision to grant a European patent pursuant to Article 97 (1) EPC in European Patent Application No. EP09178133.6, mailed on Aug. 23, 2012.

(Continued)

*Primary Examiner* — Raeann Gorden
(74) *Attorney, Agent, or Firm* — Plumsea Law Group, LLC

(57) ABSTRACT

A golf ball with a layer of composite material applied to at least one surface of one layer of the ball. The composite material includes a plurality of particles. The particles are shaped to enable specific orientations. A percentage of the particles in the composite material achieve a specific orientation. A portion of at least one of the particles extends from the composite material layer and into an adjacent, surrounding layer. The particles may have a tetrapod shape. The composite layer may be applied as a thin film coating, such as in a primer layer.

17 Claims, 21 Drawing Sheets

(56) References Cited

OTHER PUBLICATIONS

Notice of Grant of Patent Right for Utility Model in Chinese Utility Patent Application No. 201020001512.7, mailed on Dec. 29, 2010.
Notice of Decision for Patent in Korean Patent Application No. KR10-2009-0112598, mailed on Aug. 5, 2010.
Office Action issued Feb. 26, 2013 for Japanese Patent Application No. 2009-295415.
Communication pursuant to Rule 70(2) EPC and reference to Rule 39(1) EPC mailed Jan. 4, 2011 for European Patent Application No. 09178133.6.
Response to Communication pursuant to Rule 70(2) EPC and reference to Rule 39(1) EPC as filed on Jun. 17, 2011 for European Patent Application No. 09178133.6.
Communication under Rule 71(3) EPC mailed Mar. 22, 2012 for European Patent Application No. 09178133.6.
Notification of Grant of Patent Right for Utility Model issued Dec. 29, 2010 for Chinese Utility Model Patent Application No. 201020001512.7.
Notification of First Office Action issued Mar. 25, 2013 for Chinese Invention Patent Application No. 201010001619.6.
Office Action mailed Feb. 26, 2013 for Japanese Patent Application No. 2009-295415.
Examiner's Report issued Sep. 14, 2011 for Canadian Patent Application No. 2686422.
Response to Examiner's Report as filed on Mar. 12, 2012 for Canadian Patent Application No. 2686422.
Notice of Allowance issued Nov. 22, 2012 for Canadian Patent Application No. 2686422.
Office Action mailed Jul. 23, 2010 for Australian Innovation Patent No. 2010100629.
Office Action issued Oct. 30, 2012 for Japanese Patent Application No. 2009-295415.

GOLF BALL WITH ORIENTED PARTICLES

BACKGROUND

The invention relates generally to coatings for golf balls, and more particularly, to golf balls with oriented particles applied to any of a number of golf ball layers.

The history of golf ball development has gone very far from wound golf balls to solid two piece golf balls and multi-layer golf balls. Rubber cores gradually replaced wound cores because of quality consistency and performance benefit such as reducing of driver spin for longer distance.

Multi-layer golf balls with layers made of thermoplastic material such as ionomer materials brought golf ball technology to the next level. Typically, thin layers of different materials fused together added extra features such as lower spin off the tee but increasing spin around the green. For example, one of the layers may be a hard ionomer in a mantle layer while a soft elastomer material forms the layer for outer cover. Thin layers of ionomer layers were typically used because ionomer has relatively low resilience, particularly when compared to the rubbers typically used to form the core or the layers of the core.

Flying distance is an important index used to evaluate the performance of a golf ball. Flying distance is affected by three main launch condition factors: initial velocity", "spin rate", and "launch angle". Initial velocity is one of the primary physical properties affecting the flying distance of the golf ball. The coefficient of restitution (COR) is an alternate parameter of initial velocity of the golf ball, and the temperature will affect the COR. The COR is generally defined as the ratio of velocity of an object before and after an impact. A COR of 1 is a perfect elastic collision where no energy is lost due to the collision, and a COR of 0 is a perfect inelastic collision, where all of the energy is dissipated during the collision.

The spin rate of a ball is measured in two main ways, as these different types of spin have different impacts on the flight of the ball. The spin of the ball against the direction of flight is known as "back spin". Any spin to the ball that is oriented at an angle to the direction of flight is "side spin". Back spin generally affects the distance of the ball's flight. Side spin generally affects the direction of the ball's flight path.

The spin rate of the ball generally refers to the speed that the ball turns about an axis through the center of the ball. The spin rate of the ball is typically measured in revolutions per minute. Because the spin of the ball generates lift, the spin rate of the ball directly impacts the trajectory of the ball. A shot with a high spin rate flies to a higher altitude than a ball with a low spin rate. Because the ball flies high with high spin, the overall distance traveled by a ball hit with excessive spin is less than an ball hit with an ideal amount of spin. A ball hit with insufficient spin will not generate enough lift to increase the carry distance, resulting in a serious loss of distance. Therefore, hitting a ball with the ideal amount of spin can maximize the distance traveled by the ball.

In addition to affecting the shape of the flight path and/or trajectory of a ball, the spin of a golf ball can also affect the run of the ball, i.e., the distance a ball rolls once the ball hits the ground. Balls with a high spin rate stop sooner than balls hit with a low spin rate. In other words, the run of the ball is lower with a high-spin ball than with a low-spin ball. Therefore, on shots where control is more important than distance, such as approach shots, a high spin is generally preferred.

While a golfer's club and technique play large roles in providing spin to the ball, the ball itself has characteristics that affect the spin rate of the ball. A ball with a soft cover material, such as balata, will achieve a greater level of back spin than a ball with a hard cover. However, balls with soft cover materials are generally more expensive, less durable, and more difficult to play than balls with harder covers. Balls with hard cover materials, such as Surlyn®, are less expensive, but average golfers may find the spin on such balls hard to maximize or difficult to control.

Therefore, there is a need in the art for balls that provide controllable levels of spin.

SUMMARY OF THE INVENTION

A golf ball is provided with a composite material layer to assist in controlling the spin of the golf ball. The composite material layer includes a matrix material and particles suspended in the matrix material. The particles are shaped and sized irregularly so that the orientation of the particles within the matrix can be changed. The particles may be of any type or shape known in the art, but a portion of at least some of the particles extend out of the matrix material and into an adjacent layer of material that surrounds the composite material layer.

In some embodiments, the invention provides a golf ball comprising a cover; a coating applied to the cover; the coating comprising a first layer and a second layer; the first layer of the coating comprising a plurality of particles, wherein each particle in the plurality of particles has an irregular peripheral shape; wherein a first group of particles in the plurality of particles is positioned within the first layer in a pre-determined orientation; and wherein a portion of at least one particle of the plurality of particles extends into the second layer.

In another aspect, some embodiments of the invention provide a golf ball comprising a first layer; a second layer surrounding the first layer; a composite material layer positioned between the first layer and the second layer; the composite material layer comprising a plurality of particles, wherein each particle in the layer of particles has a non-uniform shape, and wherein a percentage of the plurality of particles is positioned within the layer of particles in a pre-determined orientation; and wherein at least a portion of one of the particles extends from the particle layer into at least one of the first layer and the second layer.

In some aspects, embodiments of the invention provide a golf ball comprising a core; a layer surrounding the core; a particle layer disposed between the core and the layer; the particle layer comprising a plurality of particles; each particle comprising a core and a plurality of projections extending away from the core, each projection having a length measured from the core to a tip of the projection; each particle having a diameter measured by inscribing a sphere around the tips of each of the projections, wherein the diameter of the sphere is the diameter of the particle, wherein the diameter of each particle is less than 200 microns; and wherein at least one particle is oriented so that at least one projection extends from the particle layer into the layer.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

A golf ball is provided with a composite material layer to assist in controlling the spin of the golf ball. The composite material layer includes a main material and particles suspended in the main material. The particles are shaped and sized irregularly so that the orientation of the particles within the matrix can be changed. The particles may be of any type or shape known in the art, but a portion of at least some of the particles extend out of the matrix material and into an adjacent layer of material that surrounds the composite material layer.

For the purposes of this description, "inner" or "interior" refer to the direction toward the core of the golf ball. Similarly, "outer" or "exterior" refer to the direction toward the cover or the visible/touchable surface of the golf ball.

Figure 1:
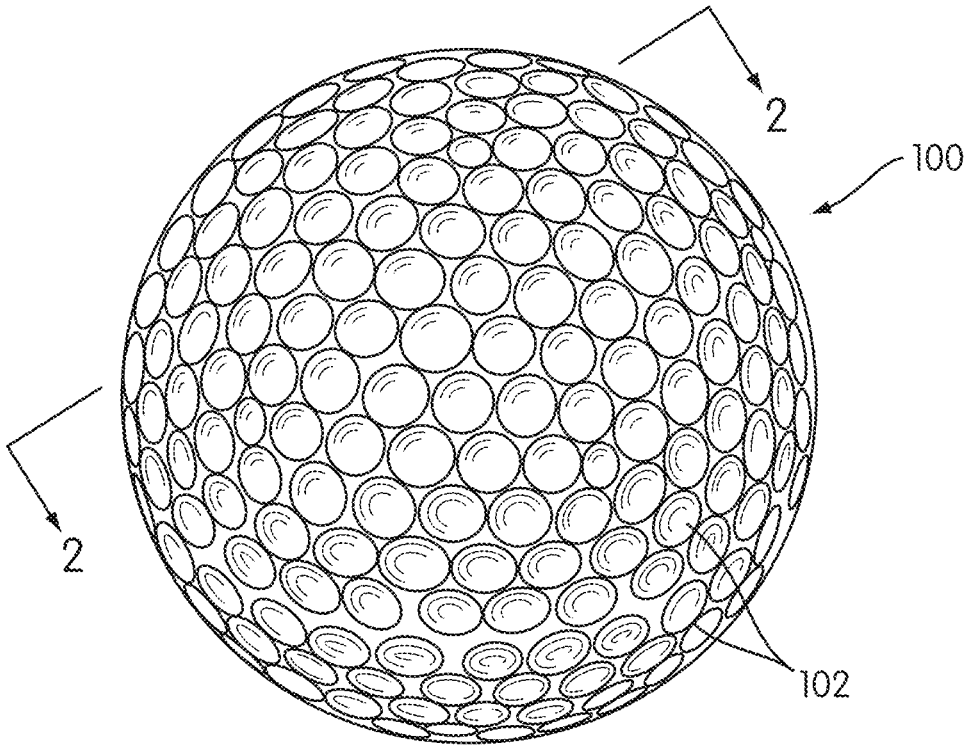
FIG. 1 is a schematic diagram of an embodiment of a dimpled golf ball.

FIG. 1 shows a perspective view of a solid golf ball 100 according to the invention. Golf ball 100 is generally spherical in shape with a plurality of dimples 102 disposed on the surface of golf ball 100. Any number of dimples 102 may be provided on the surface of golf ball 100. In some embodiments, the number of dimples 102 may range from about 250 to about 500. In some embodiments, the number of dimples 102 may range from about 300 to about 400. Dimples 102 may be arranged on the surface of golf ball 100 in any pattern.

Though shown as substantially hemispherical, dimples 102 may have any shape known in the art, such as elliptical, polygonal, or the like. While in some embodiments dimples 102 may be protrusions extending away from the surface of golf ball 100, dimples 102 are typically indentations in the surface of golf ball 100. Each indentation defines a volume. For example, if a dimple is a hemispherical indentation in the surface, the space carved out by the dimple and bounded by an imaginary line representing where the surface of golf ball 100 would be if no dimple were present has a volume of a hemisphere, or $\frac{2}{3}\pi r^3$, where r is the radius of the hemisphere. In some embodiments, all dimples 102 may have the same diameter or radius. In other embodiments, dimples 102 may be provided with different diameters or radii. In some embodiments, each dimple may have a diameter or radius selected from a preselected group of diameters/radii. In some embodiments, the number of different diameters/radii in the preselected group of diameters/radii ranges from three (3) to six (6). In some embodiments, the number of dimples 102 with the greatest diameter/radius is greater than the number of dimples with any other diameter/radius. In other words, in such an embodiment, there are more of the largest dimples than dimples of any other size.

The aggregate of the volumes of all of dimples 102 on the surface of golf ball 100 is a total dimple volume. In one embodiment, the total dimple volume is about 550 $mm^3$ to about 800 $mm^3$. In some embodiments, the total dimple volume may range from about 600 $mm^3$ to about 800 $mm^3$.

Figure 2:
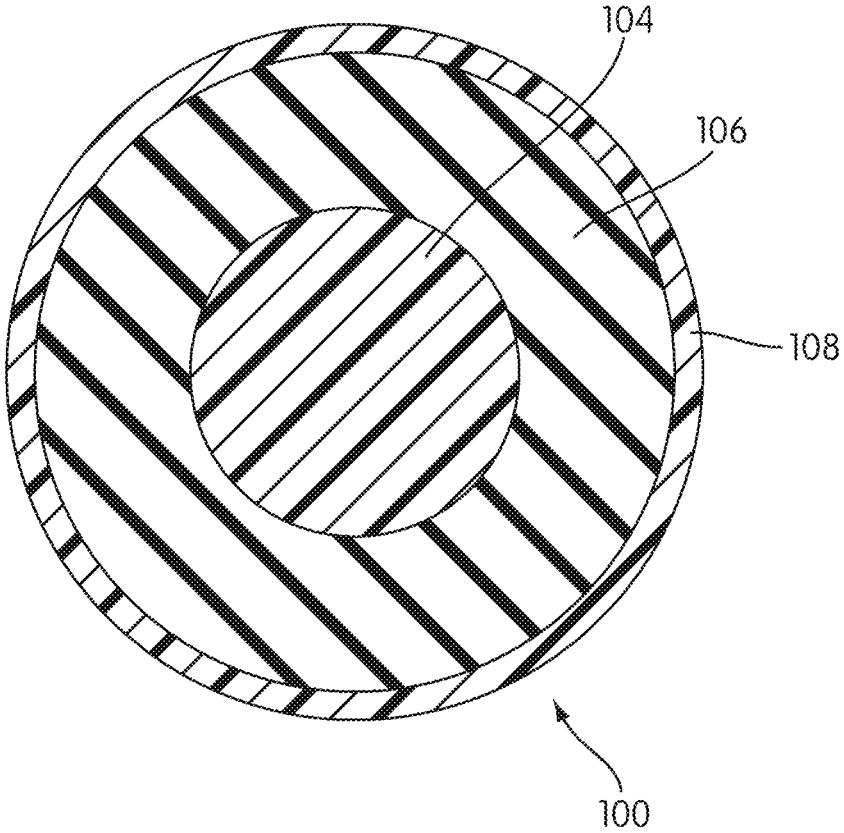
FIG. 2 is a schematic cross-sectional diagram of an embodiment of a solid golf ball having three layers.

Internally, golf ball 100 in some embodiments is constructed as a multilayer solid golf ball. In other words, multiple layers of material are fused or compressed together to form the ball. In other embodiments, golf ball 100 may have any type of internal construction. As shown in FIG. 2, one embodiment of golf ball 100 includes a core 104, a cover 108, and an outer core layer 106 sandwiched between core 104 and outer core layer 106. Together, core 104 and outer core layer 106 may be considered to be an "inner ball".

Core 104 may be made using any method known in the art, such as hot-press molding or injection molding. Core 104 of the present invention may be single layer or multilayer construction, and any material may be used to make core 104. The core material may be selected to have specific performance characteristics, such as manipulating the COR.

In some embodiments, core 104 may be made of rubber or materials containing natural or synthetic rubber. In some embodiments, core 104 may be made from a thermoplastic material or a thermoset material. The thermoplastic material of core 104 may be an ionomer resin, a bi-modal ionomer resin, a polyamide resin, a polyester resin, a polyurethane resin, and combinations thereof. In one embodiment, core 104 is formed from an ionomer resin. For example, core 104 may be made from HPF and Surlyn®, both commercially available from E. I. Dupont de Nemours and Company, and IOTEK®, commercially available from Exxon Corporation.

In some embodiments, a diameter of core 104 may be in a range between about 19.0 millimeters and about 37.0 millimeters. In some embodiments, the diameter of core 104 may range from about 19.0 millimeters and about 32 millimeters. In some embodiments, the diameter of core 104 may range between about 21.0 millimeters and about 35.0 millimeters. In some embodiments, the diameter of core 104 may range between about 23.0 millimeters and 32.0 millimeters.

In the embodiment shown in FIG. 2, outer core layer 106 covers and substantially encloses core 104. Outer core layer 106 has an interior surface facing an exterior surface of core 104. In the embodiment shown in FIG. 2, the exterior surface of outer core layer 106 faces an interior surface of cover 108. Outer core layer 106 may have any thickness. In one embodiment, the thickness of outer core layer 106 may range from about 3 millimeters to about 11 millimeters. In one embodiment, the thickness of outer core layer 106 may range from about 4 millimeters to about 10 millimeters.

Outer core layer 106 may be made from a thermoset material. In some embodiments, the thermoset material may be a rubber composition using any rubber composition known in the art.

In some embodiments, additives, such as a crosslinking agent and a filler with a greater specific gravity may be added to the rubber composition. A suitable crosslinking agent can be selected from the group consisting of peroxide, zinc acrylate, magnesium acrylate, zinc methacrylate, and magnesium methacrylate.

Figure 3:
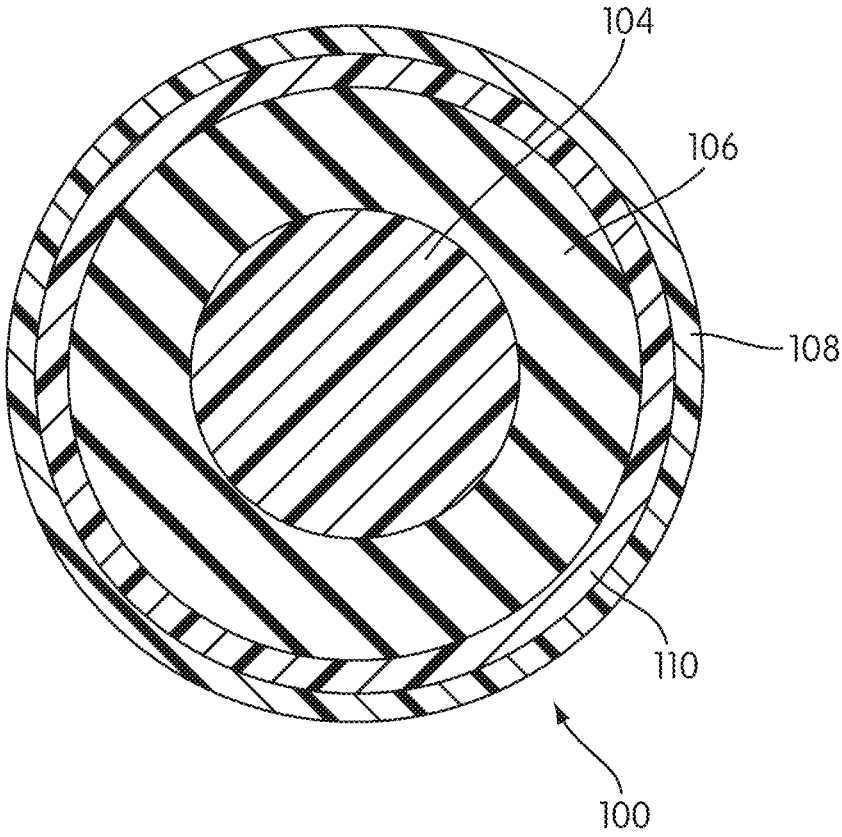
FIG. 3 is a schematic cross-sectional diagram of an embodiment of a solid golf ball having four layers.

In some embodiments, such as the embodiment shown in FIG. 3, ball 100 may include additional layers between core 104 and cover 108. For example, as shown in FIG. 3, a mantle layer 110 may be provided. Mantle layer 110 may be a thick or thin layer of material, which may be any type of material known in the art. In some embodiments, mantle layer 110 is made from a relatively hard material to obtain certain performance characteristics, such as to help decrease back spin and the tendency of the ball to deform. In other embodiments, mantle layer 110 may be made from a relatively soft material so obtain different performance characteristics, such as to help increase back spin and the tendency of the ball to deform.

Golf ball 108 includes a cover layer 108. The hardness of cover layer 108 plays a role in the amount of back spin that a golfer will be able to impart to golf ball 100. Traditionally, soft covers are provided for balls that produce more back spin. An example of a soft cover material is balata. Skilled golfers may choose to use a soft cover for the back spin and control properties, but new golfers may find that soft cover balls lack durability. This may be particularly true if the ball is not hit properly with every swing, as the soft cover materials may dent or tear when hit improperly.

Similarly, harder covers are provided for balls that produce low back spin but, generally, longer carry distance. An example of a hard cover material is an ionomer, such as Surlyn. While more durable than the soft cover balls, hard cover balls are more difficult to make back spin, which can limit the number of play options in a golfer's arsenal.

Efforts have been made to find a medium cover ball that can produce the desired effects of both the soft cover balls and the hard cover balls. Composite materials have been examined for use in covers. In the embodiments described herein, layers of composite material containing oriented particles are provided at various locations in a golf ball to impart desirable characteristics to the ball.

Figure 4:
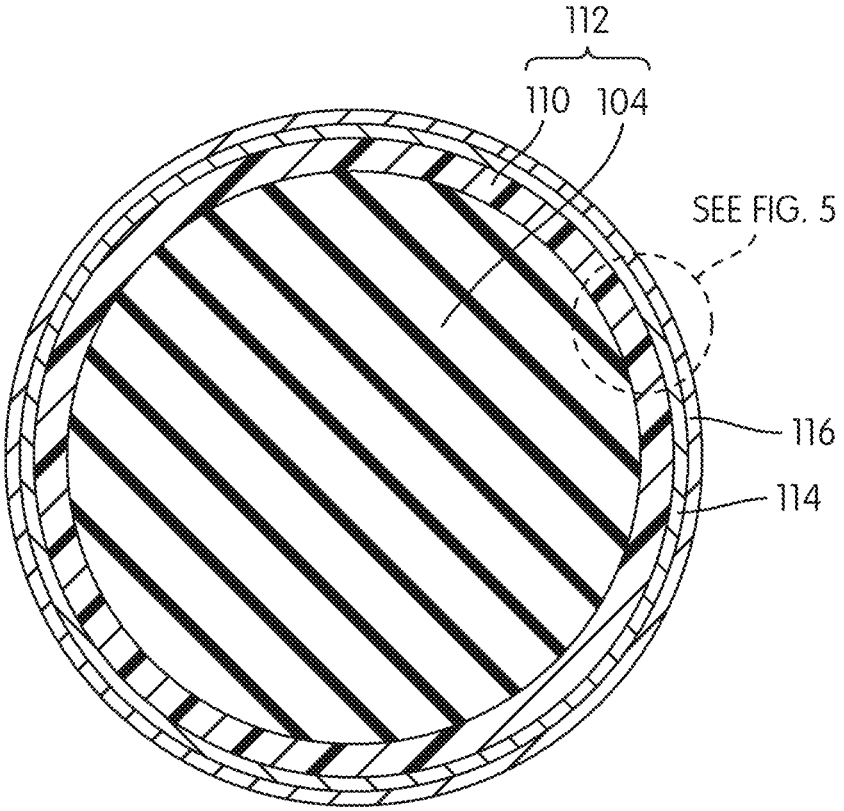
FIG. 4 is a schematic cross-sectional diagram of an embodiment of a solid golf ball having two coating layers.

As shown in FIG. 4, an embodiment of a golf ball with oriented particles in the coating layers of the golf ball is shown. Two coating layers, a first layer 114 and a second layer 116, are shown surrounding an otherwise uncoated golf ball 112. Uncoated golf ball 112 is essentially all of the layers of golf ball 100 prior to the application of primers, paints, top coatings, or other thin film layers applied to the outer surface of a golf ball. In the embodiment shown in FIG. 4, first layer 114 is positioned adjacent to and in contact with the outer surface of uncoated golf ball 112. In some embodiments, first layer 114 is adhered, cured to, or otherwise fixedly attached to the outer surface of uncoated golf ball 112 with sufficient adhesive force to withstand repeated high speed impacts with golf clubs. Second coating layer 116 is adjacent to and in contact with the outer surface of first layer 114. In some embodiments, second layer 116 is adhered, cured to, or otherwise fixedly attached to the outer surface of first layer 114 with sufficient adhesive force to withstand repeated high speed impacts with golf clubs.

Figure 5:
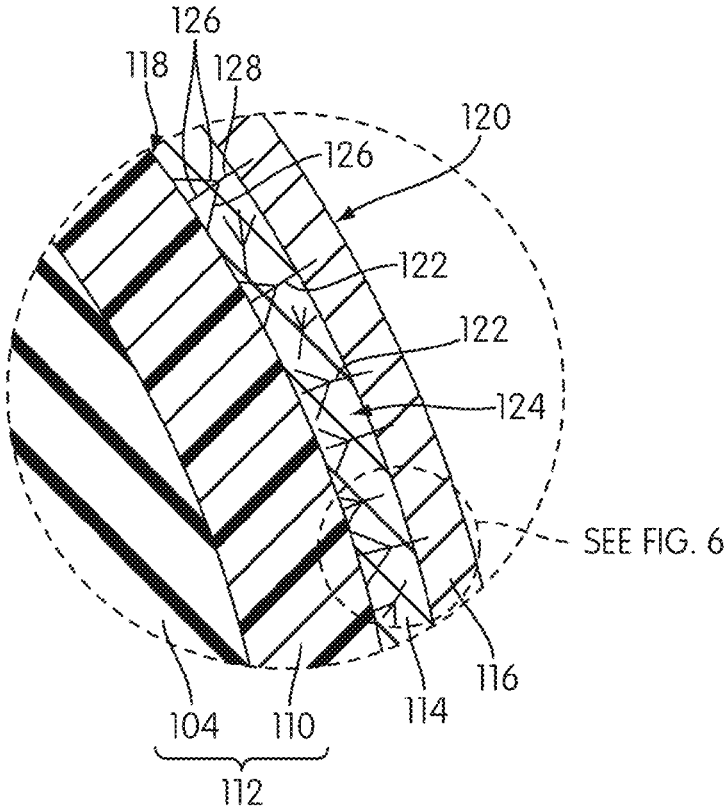
FIG. 5 is a schematic enlarged cross-sectional diagram of the coating layers of the solid golf ball shown in FIG. 4.

FIG. 5 shows an enlarged view of the layers of the golf ball at the surface of the ball. Uncoated ball 112 includes a core 104 and a cover 110. First layer 114 surrounds cover 110. First layer 114 is a composite material layer formed from a matrix material 124 in which a plurality of particles 122 are embedded. The matrix material 124 may be any type of material known in the art, such as a plastic material, a rubber material, or a polymer. In some embodiments, matrix material 124 is a paint primer. The primer is used to increase the adhesion of any subsequently applied paint layers to the material of the cover. The primer matrix material may be any type of primer material known in the art. Various types of lacquer and epoxy are commonly used as primers for golf balls.

Particles 122 may be any type of shaped particle. Particles 122 are generally provided to increase the hardness of first layer 114, therefore, in some embodiments, particles 122 are selected to have a greater hardness and/or stiffness than matrix material 124. Particles 122 may be made from any material known in the art, such as plastics, composite materials, and metals. In some embodiments, particles 122 are made from zinc oxide.

Particles 122 are non-uniform or irregularly shaped. The irregular shape may be defined by an irregular surface, an irregular perimeter, protrusions, extensions, prongs or any configuration that allows a particle to be placed on a surface or within a matrix in a particular, knowable orientation. Particles 122 may have the shape of any polygon, geometrical shape, or the like. For example, particles 122 may be cubes, as the cube could be placed on either a leg or the corner (vertex where three legs meet.) A uniform shape would be a shape like a sphere whose orientation within a matrix is not able to be ascertained by simply viewing the particle, the particle orientation may be determined by marking the particle prior to insertion into the matrix.

Particles 122 may all have the same irregular shape or different irregular shapes. In one embodiment, as shown in FIGS. 5-8 and 11-15, the irregular shape of particles 122 is that of a tetrapod. Zinc oxide particles are available from Panasonic under the trade name PANATETRA®. As shown in FIGS. 11-14, the tetrapod particle 122 includes four legs or filaments or "whiskers": a top leg 128 extending away from three base legs 126, a first base leg 142, a second base leg 144, and a third base leg 146. The legs join together at a juncture or core 150, shown best in FIG. 12. The legs may be the same length, approximately or substantially the same length, or different lengths. In some embodiments, portions of the particles may break off prior to application to the golf ball, leaving the formed particles and portions of the formed particles in matrix material 124.

Figure 11:
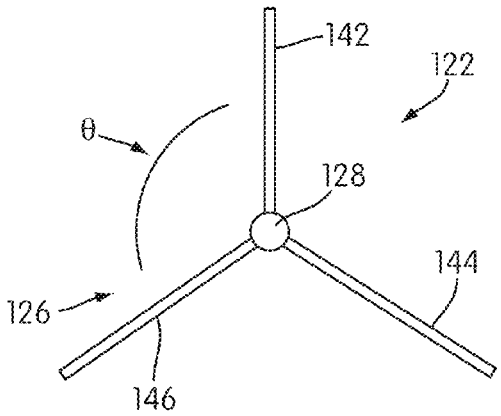
FIG. 11 is a schematic top view of an embodiment of a tetrapod particle.
Figure 12:
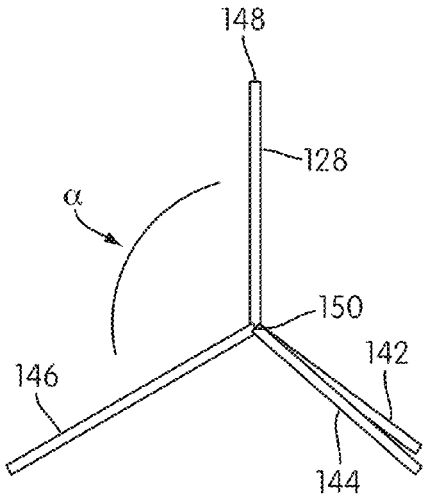
FIG. 12 is a schematic side view of an embodiment of a tetrapod particle.
Figure 13:
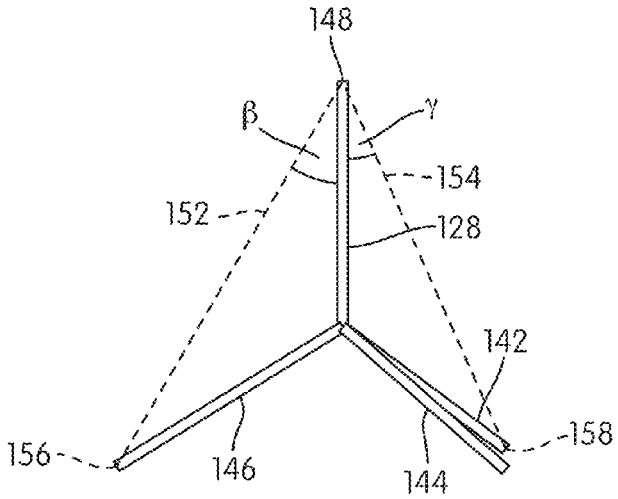
FIG. 13 is a schematic side view of an embodiment of a tetrapod particle with imaginary lines drawn from the tip of the top leg to the tip of two of the base legs.

FIG. 11 shows a top view of an exemplary tetrapod particle 122, where the three base legs 126 are shown positioned at a first angle $\theta$ to each other. First angle $\theta$ is approximately 120 degrees. FIG. 12 shows a side view of an exemplary tetrapod particle 122, where top leg 148 extends away from the base legs at a second angle $\alpha$. Second angle $\alpha$ is approximately 109.5 degrees. FIG. 13 shows a side view of an exemplary tetrapod particle, with a first imaginary line 152 extending from a top leg tip 148 to a third base leg tip 156. A second imaginary line 154 extends from top leg tip 148 to a first base leg tip 158. Top leg 128 and first imaginary line 152 define third angle $\beta$, and top leg 128 and second imaginary line 154 define fourth angle $\gamma$. If all legs are the same length, then third angle $\beta$ and fourth angle $\gamma$ may be approximately the same. Otherwise, in some embodiments, third angle $\beta$ and fourth angle $\gamma$ may range from about 19.47 degrees to about 35.25 degrees.

The size of particles 122 may be any desired size. In some embodiments, all particles 122 are the same size or approximately the same size. In other embodiments, particles 122 have a range of sizes. In some embodiments, particles 122 are also intended to reside within thin film layers, so the size of the particles may range from about 1 micron to about 50 microns. In other embodiments, the size of particles can be any desired size, even if residing in thin film layers. In some embodiments, the size of particles 122 may be 200 microns or less. The size of particles 122 may be measured by any desired method, but one method is to draw a sphere around a particle that encloses the largest extensions of the particle. The diameter or the radius of that sphere may be used as an appropriate measure. Similarly, if particles 122 are tetrapod particles, then leg length as measured from core 150 to a leg tip such as top leg top 148 or first base leg tip 158 may be used as a determination of particle size.

The concentration of particles 122 may vary depending upon the desired ball performance characteristics. In some embodiments, the concentration of particles 122 within first layer 114 when matrix material 124 is still wet or uncured ranges from about 1 PPH to about 20 PPH. In some embodiments for decreasing back spin, the concentration of particles 122 within first layer 114 may range from about 3 PPH to about 10 PPH when matrix material 114 is wet or uncured. As matrix material 124 dries or cures, this concentration may increase. In some embodiments, the concentration of particles 122 within first layer 114 may double. In other embodiments, the concentration of particles 122 within first layer 114 may increase by a lesser or greater amount.

Referring again to FIG. 5, second coating layer 116 may be any type of thin film coating layer known in the art. In some embodiments, second coating layer 116 is a paint layer. The paint material may be any type of paint known in the art, such as UV-curable paint, urethane materials, water based materials, or the like.

As shown in FIGS. 5-8, first coating layer 114 is applied so that at least some particles 122 may obtain a specific, pre-selected orientation as first coating layer 114 dries or cures. For example, in some embodiments, the specific desired orientation of particle 122 when particle 122 is a tetrapod is so that base legs 126 abut or face exterior surface 118 of uncoated ball 112. This specific, pre-selected, desired orientation of particle 122 allows for a predictable response to forces applied to the finished golf ball. For example, when particle 122 is a tetrapod with the base legs 126 abutting or facing exterior surface 118, particle 122 responds to impact forces like when the surface of a tripod is pushed down.

Figure 14:
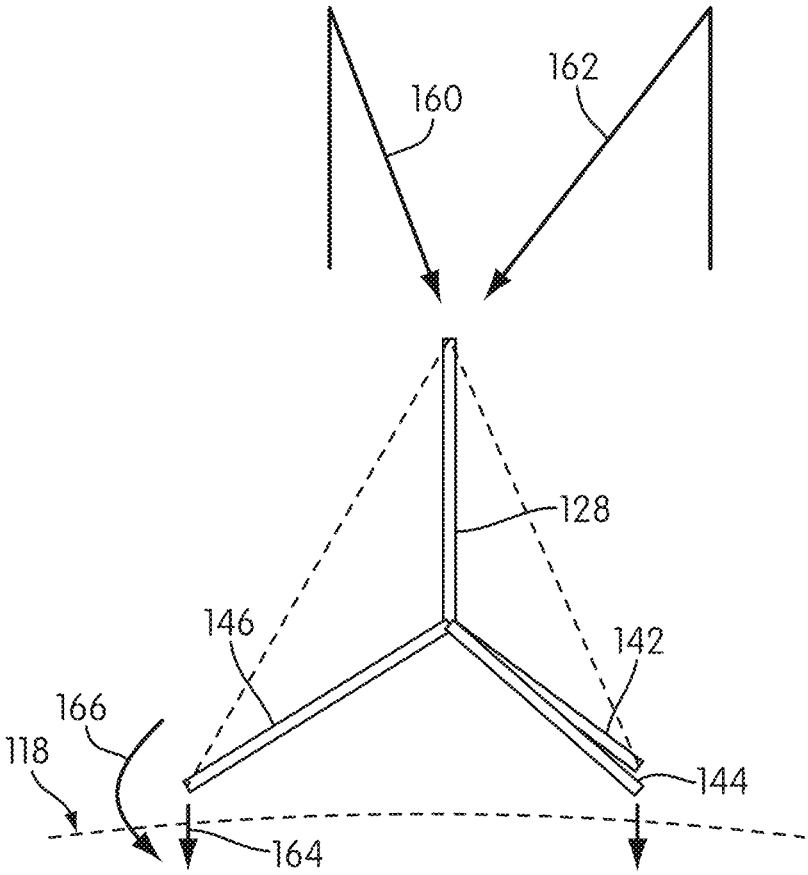
FIG. 14 is a schematic force diagram showing the forces on a tetrapod particle at the surface of a golf ball when the ball is hit by a club.

As shown in FIG. 14, the impact of a club head with a ball can be resolved into a first force 160 and a second force 162, both of which approach top leg 128 at angles. In a proper hit, first force 160 translates through particle 122 to push first base leg 142, second base leg 144, and third base leg 146 into the exterior surface 118 of the uncoated ball, as indicated by arrows 164. This response can allow a designer to manipulate the spin of a ball in at least one additional way. If the material for the cover is soft, particle 122 can dig into the surface to reduce the effect that particle 122 has on spin. If the material for the cover is hard, the cover resists the pressing of particle 122 into the cover and the impact on spin can be increased. Under test conditions, it is determined that when the force angle is less than 19.5 degrees, spin is decreased. When the force angle is between 19.5 degrees and 35.3 degrees, spin changes randomly. When the force angle is greater than 35.3 degrees, spin is increased. The spin consistency is increased for force angles less than 19.5 degrees and force angles greater than 35.3 degrees.

In a proper hit, second force 162 twists particle 122 against exterior surface 118 of the uncoated ball, as indicated by arrow 166. Because of the varying angles of the legs of tetrapod particle 122, if particle 122 were hit when positioned in a different orientation, the forces would translate through particle 122 differently.

This varying response to forces depending upon the location of the application of the forces differentiates the irregular particles of these embodiments from the responses of uniform particles to forces. The response of a uniform particle to an applied force will be the same regardless of the orientation of the particle within a matrix or the location of the application of the force on the surface of the particle. In other words, particles 122 are anisotropic or orthotropic as opposed to isotropic as the force response is directionally dependent.

Figure 15:
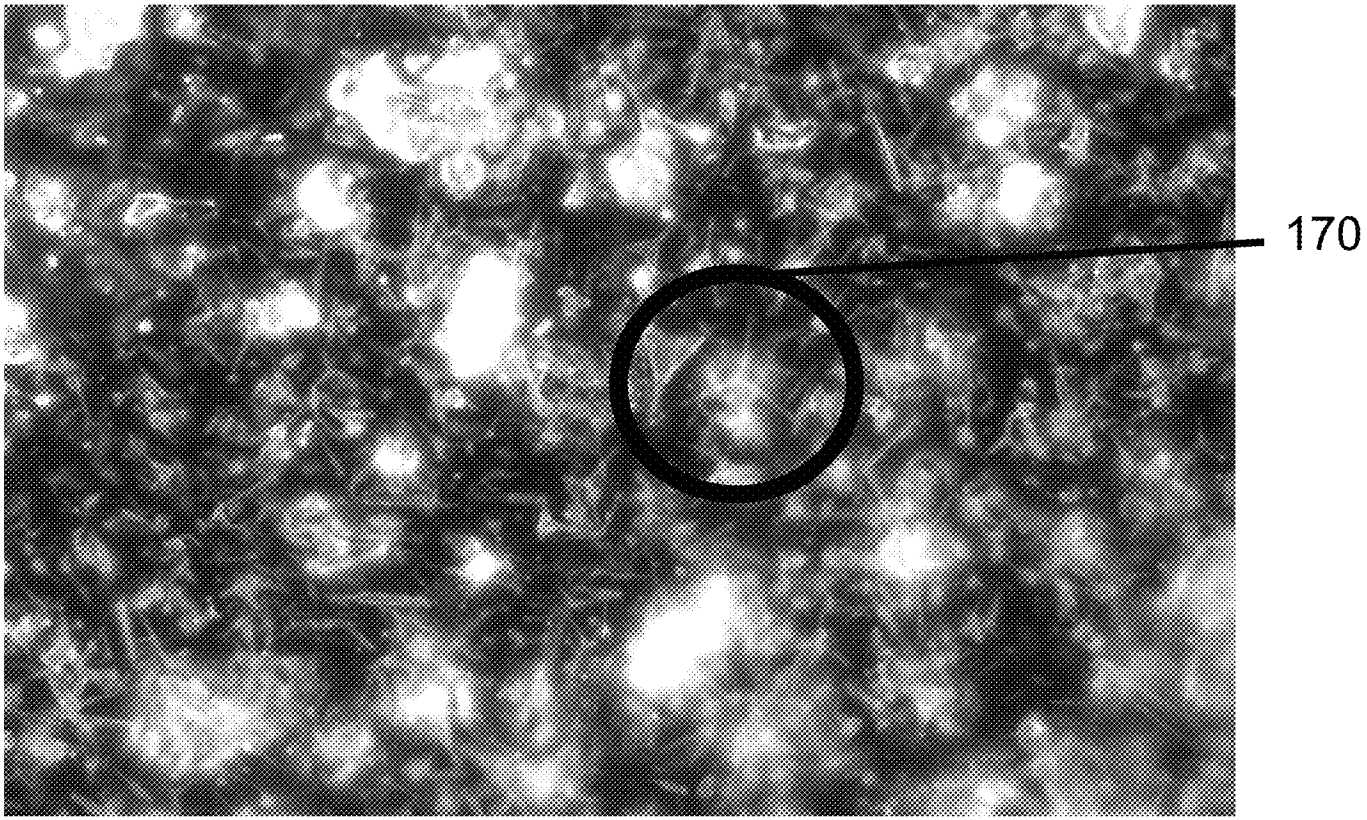
FIG. 15 is a photograph taken by a microscope showing the orientation of a tetrapod particle at the surface of a golf ball.

As shown in FIG. 5, not all particles 122 are expected to achieve the desired orientation within matrix material 124. In some embodiments, between 5 percent and 95 percent of particles 122 achieve the desired orientation. The method for applying first coating layer 114 assists in having particles 122 achieve the desired orientation. For example, when currently used in moldable articles, tetrapod particles are applied as part of a molded layer, with the particles injected with the matrix material into a mold. Due to the injection process, the tetrapod particles tend to align with the direction of flow into the mold. Further, a particle front can form in the matrix at the boundary between two flow layers. When applying a thin film, however, the composite material may be sprayed onto the previously molded surface of a ball or layer of a ball. This allows for uniformity of particle concentration throughout first coating layer 114. The spraying of the composite material also allows the particles to settle into an orientation. If the size of the particle is chosen to be approximately the same or larger than the height or thickness of the thin film of first coating layer 114 that is formed from matrix material 124, particles 122 will tend to settle with the base legs abutting or facing the exterior surface of the layer onto which the composite material is being sprayed. In some embodiments, the thickness of matrix material 124 ranges from about 2 microns to about 15 microns. In some embodiments, the thickness of matrix material 124 may be smaller or larger. FIG. 15 is a photograph from a microscope of a surface of a golf ball to which Panatetra particles in a primer matrix material has been applied. The tripod configuration of the particles in the matrix can be readily discerned, such as the particle highlighted by circle 170.

Figure 6:
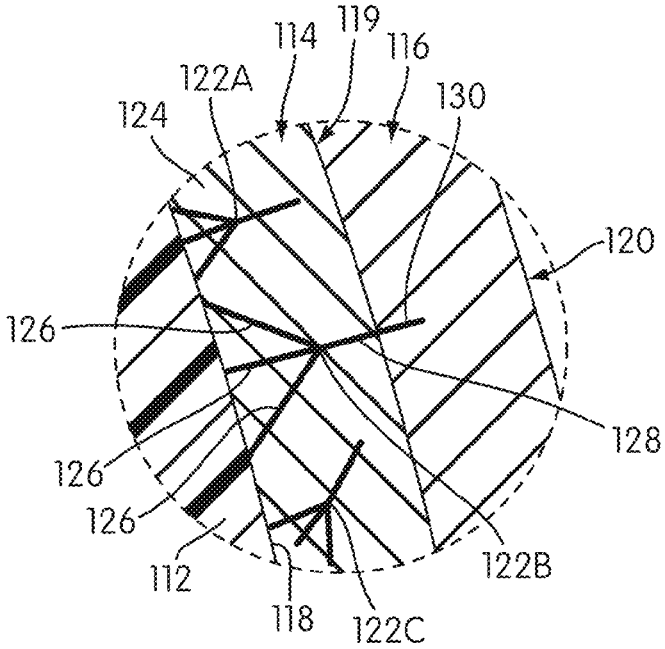
FIG. 6 is a schematic enlarged cross-sectional diagram of a portion of the coating layers of the solid golf ball shown in FIGS. 4 and 5 to show an embodiment where a coating layer is a composite material layer.

Another advantage to providing particles 122 of a similar or larger size than the thickness of matrix material 124 is to allow at least a portion of at least one of particles 122 to extend through an outer surface 119 of matrix material 124, as shown most clearly in FIG. 6. This extension allows a portion 130 of particle 122 to become embedded within the adjacent layer, second coating layer 116. This linkage of the coating layers allows for better adhesion of the layers, and links the mechanical response of the layers together. Thus, when exposed to an impact force, first coating layer 114 and second coating layer 116 will respond more like a linked system as opposed to separate systems with a boundary layer. Not only does this mechanism assist in controlling back spin by stiffening both layers, but this can also help prevent the layers from delaminating over the lifetime use of the golf ball.

Figure 7:
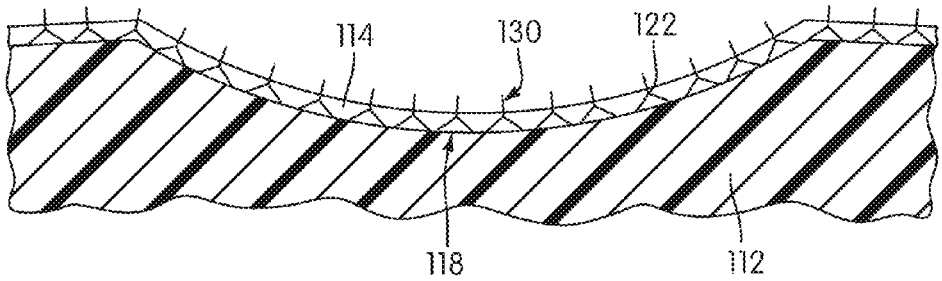
FIG. 7 is a schematic enlarged diagram of an embodiment of a golf ball dimple showing an embodiment of a composite material layer in the dimple as a first coating layer.
Figure 8:
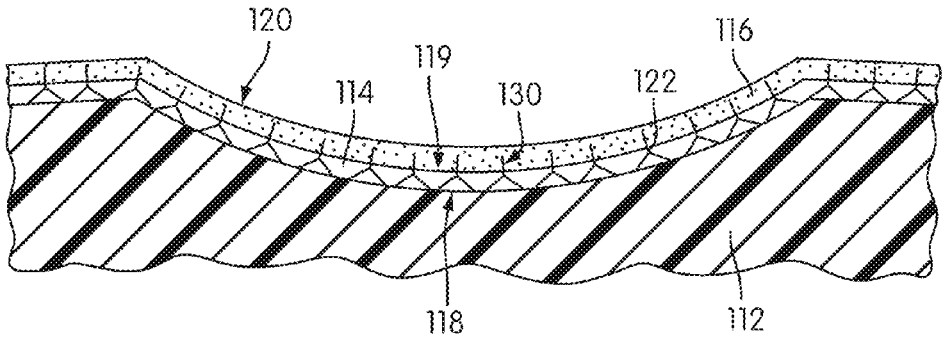
FIG. 8 is a schematic enlarged diagram of an embodiment of a golf ball dimple showing an embodiment of a composite material layer in the dimple as a first coating layer with a second coating layer covering the first coating layer.

Extending particles from first coating layer 114 and into second coating layer 116 also helps to even the application of the coating layers over surface features, such as dimples. When coating a dimpled ball, the coatings can accumulate in unpredictable patterns around the surface features, such as within the cavity of a dimple or around the edges of a dimple. A dimple cavity is shown in FIGS. 7 and 8. In FIG. 7, first coating layer 114 is applied thinly so that portion 130 of particles 122 protrudes from the outer surface of first coating layer 114. In one example, to help assure the proper orientation, first coating layer 114 is applied to a thickness of between about 3 microns to about 5 microns when the size of particles 122 ranges from about 3 microns to about 15 microns. As shown in FIG. 8, second coating layer 116 is applied over the protruding tips of particles 122, which may help to smooth the flow of second coating layer 116 to help achieve a more consistent thickness. Also, because two very thin layers are being used, the layers are less likely to accumulate in unexpected ways on the surface features.

In some embodiments, second coating layer 116 is applied to a thickness that will assure the coverage of the protruding portions of particles 122. For example, when applied to a first coating layer 114 containing particles of 3 microns to about 15 microns in a 3 micron to about 15 micron thick matrix material, the thickness of second coating layer 116 may range from about 15 microns to about 20 microns. Otherwise, particles 122 can become surface features and impact the flow of air over the surface of the ball. In other embodiments, particles 122 may be used to provide surface features to impact aerodynamic flow.

Figure 9:
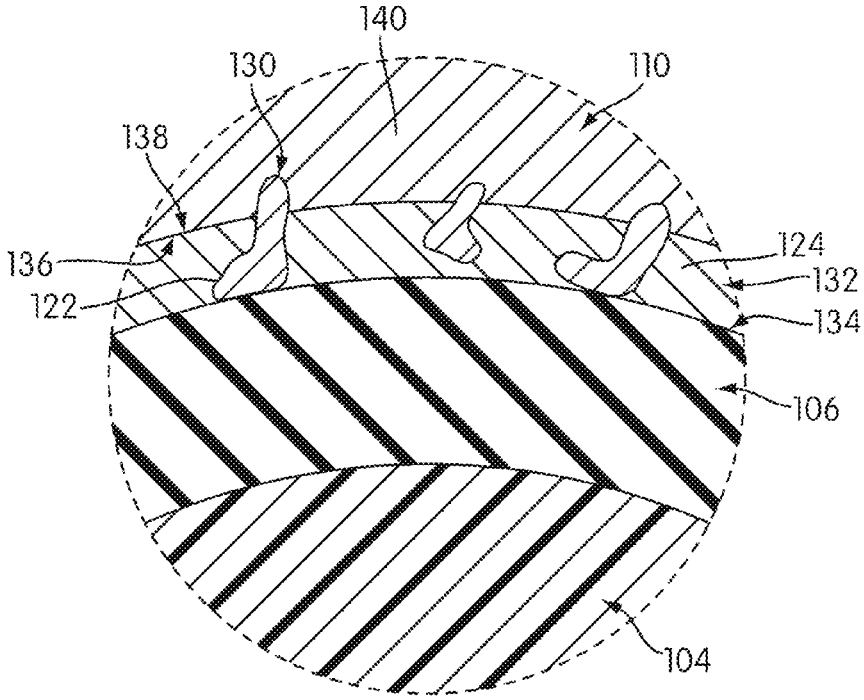
FIG. 9 is a schematic enlarged cross-sectional diagram of a portion of an embodiment of two layers of a solid golf ball where a composite material layer is disposed on the surface of a first layer and oriented particles extend into the adjacent layer.

Thin films of composite material with oriented particles may also be used as a composite layer 132 between any two interior layers of a golf ball. As shown in FIG. 9, irregularly shaped particles 122 in matrix material 124 are positioned between outer core layer 106 and mantle layer 110. Particles 122 are shaped to allow a portion 130 of particle 122 to extend through an outer surface 136 of matrix material 124 and an inner surface of mantle 110 to extend into a main body 140 of mantle 110.

Figure 10:
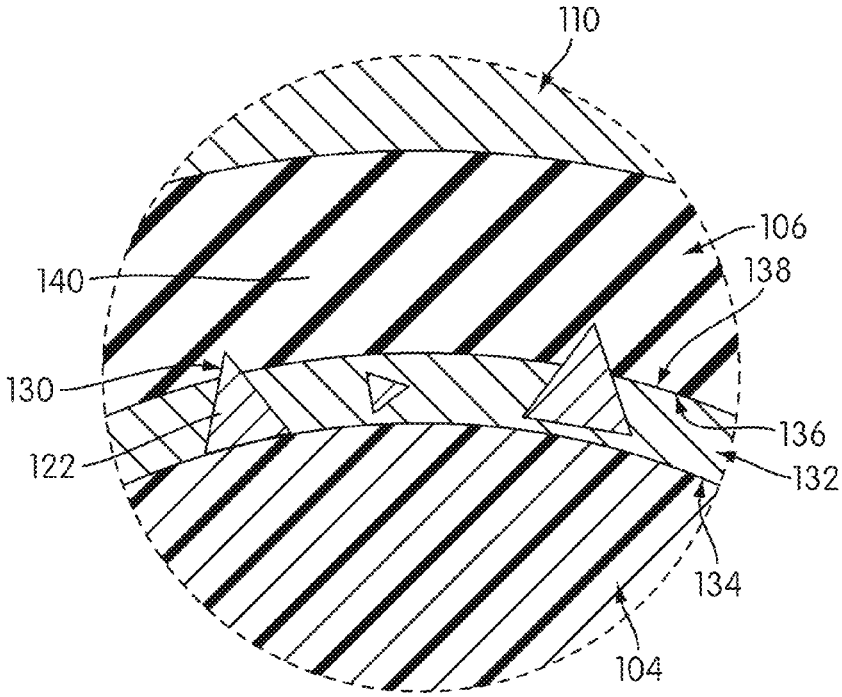
FIG. 10 is a schematic enlarged cross-sectional diagram of a portion of an embodiment of layer adjacent layers of a solid golf ball where a composite material layer is disposed on the outer surface of a core and oriented particles in the composite layer extend into the adjacent layer.

FIG. 10 shows composite layer 132 formed on an outer surface 134 of core 104. Irregularly shaped particles 122 are sized to allow a portion 130 of particle 122 to extend through an outer surface 136 of matrix material 124 and an inner surface 138 of an adjacent layer to embed into the main body 140 of the adjacent layer. While various specific layers have been discussed in the examples, a composite layer 132 with irregularly shaped particles 122 may be positioned between any two layers. In some embodiments, more than one composite layer 132 may be provided.

Composite layer 132 may be applied to an outer surface of any layer once that layer has been formed. The layers of the ball may be formed using any known method, such as by molding. Composite layer 132 may be applied to the outer surface of any layer using any method known in the art, such as by spraying. Composite layer 132 may assist in the adhesion between the layers as well as stiffening the overall profile of the golf ball.

Several tests were conducted to determine the effect of providing oriented particles in a matrix as a thin coat on a golf ball. Multiple balls were tested, and the test results are shown in FIGS. 16-26. Table 1 contains a list of the balls tested with various ball characteristics.

TABLE 1

Test balls

| Ball Designation | Shaped Particles in Coating | Solid Construction | Cover Material |
|---|---|---|---|
| First test ball 200 | 3 PPH | 2-piece | ionomer cover |
| Second test ball 202 | 5 PPH | 2-piece | ionomer cover |
| Third test ball 204 | 5 PPH | 2-piece | ionomer cover |
| Fourth test ball 206 | 1 PPH | 2-piece | ionomer cover |
| Fifth test ball 208 | 0 | 2-piece | ionomer cover |
| Sixth test ball 210 | 0 | 2-piece | IothaneTM cover |
| Seventh test ball 212 | 0 | 2-piece | soft ionomer cover |
| Eighth test ball 214 | 0 | 2-piece | ionomer cover |
| Ninth test ball 216 | 5 PPH | 2-piece | ionomer cover |
| Tenth test ball 218 | 0 | 2-piece | soft ionomer cover |

First test ball 200, second test ball 202, third test ball 204, fourth test ball 206, and ninth test ball 216 were provided with coatings having a composite layer containing Panatetra particles in various concentrations. The rest of the balls are balls with conventional coatings.

Figure 16:
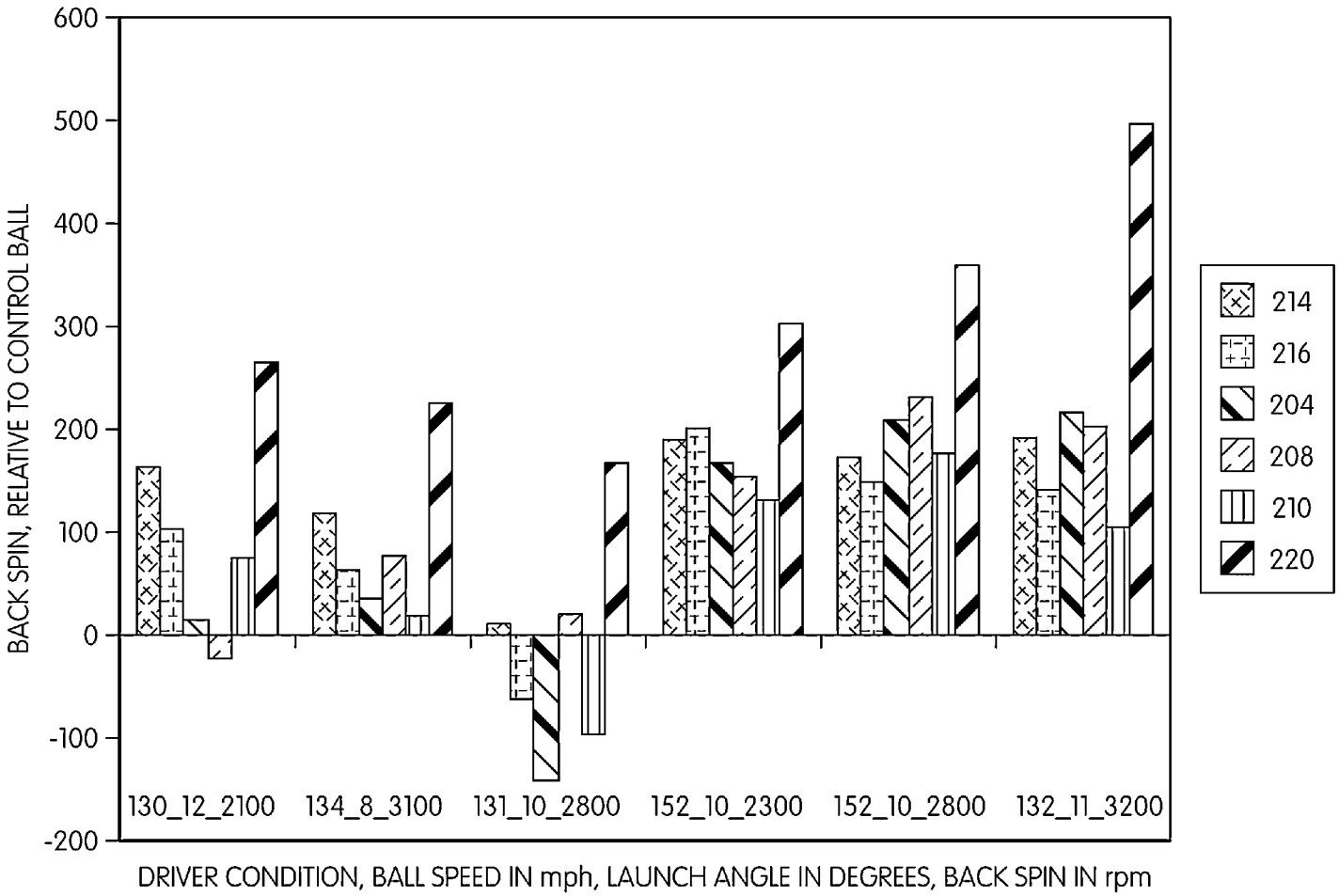
FIG. 16 is a graph showing a first set of test results when measuring back spin of multiple test balls relative to a control ball under multiple driver conditions, where some of the test balls include a composite material layer with oriented particles.
Figure 17:
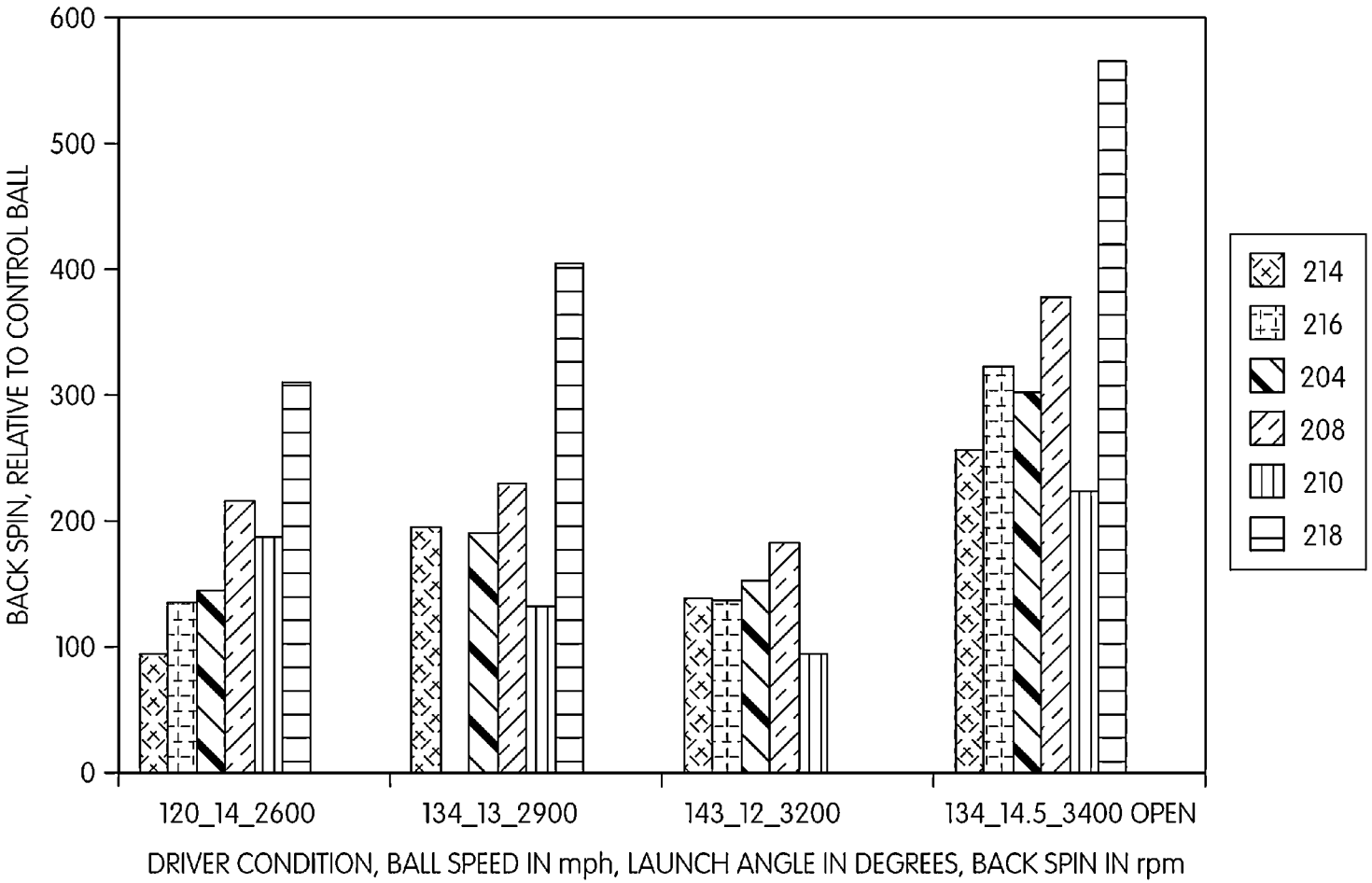
FIG. 17 is a graph showing a second set of test results when measuring back spin of multiple test balls relative to a control ball under multiple driver conditions, where some of the test balls include a composite material layer with oriented particles.

FIGS. 16 and 17 show two tests of back spin of third test ball 204, fifth test ball 208, sixth test ball 210, eighth test ball 214, ninth test ball 216, tenth test ball 218 (FIG. 17 only), and eleventh test ball 220 (FIG. 16 only) relative to a control ball, seventh test ball 212. Third test ball 204 has the same construction as fifth test ball 208, except that third test ball 204 has a composite coating with shaped and oriented Panatetra particles. Similarly, ninth test ball 216 has the same construction as eighth test ball 214, except that ninth test ball 216 has a composite coating with shaped and oriented Panatetra particles. The balls were hit with various driver conditions, as determined by ball speed measured in mph, launch angle in degrees, and back spin in rpm. As can be seen in the figures, in the first test, shown in FIG. 16, third test ball 204 has lower back spin than fifth test ball 208 in three (3) of the six (6) driver conditions. Ninth test ball 216 has lower back spin in five (5) of the six (6) driver conditions. In the second test, shown in FIG. 17, third test ball 204 has lower back spin than fifth test ball 208 in all of the driver conditions. Ninth test ball 216 has lower back spin than eighth test ball 214 in only one of the three (3) driver conditions in which both ninth test ball 216 and eighth test ball 214 were tested. This data suggests that the composite coating can decrease spin for some players.

Figure 18:
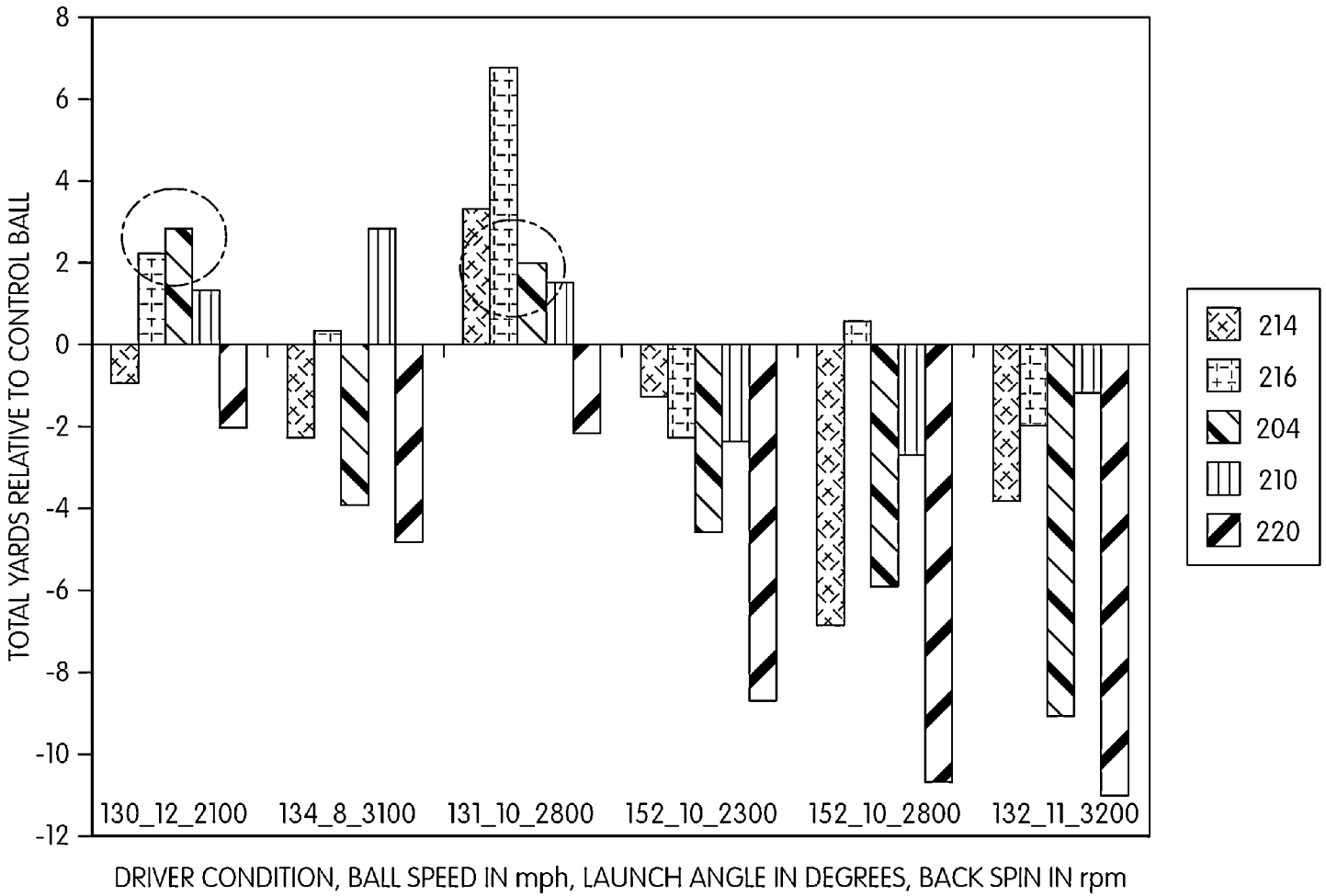
FIG. 18 is a graph showing a first set of test results when measuring total yards of multiple test balls relative to a control ball under multiple driver conditions, where some of the test balls include a composite material layer with oriented particles.
Figure 19:
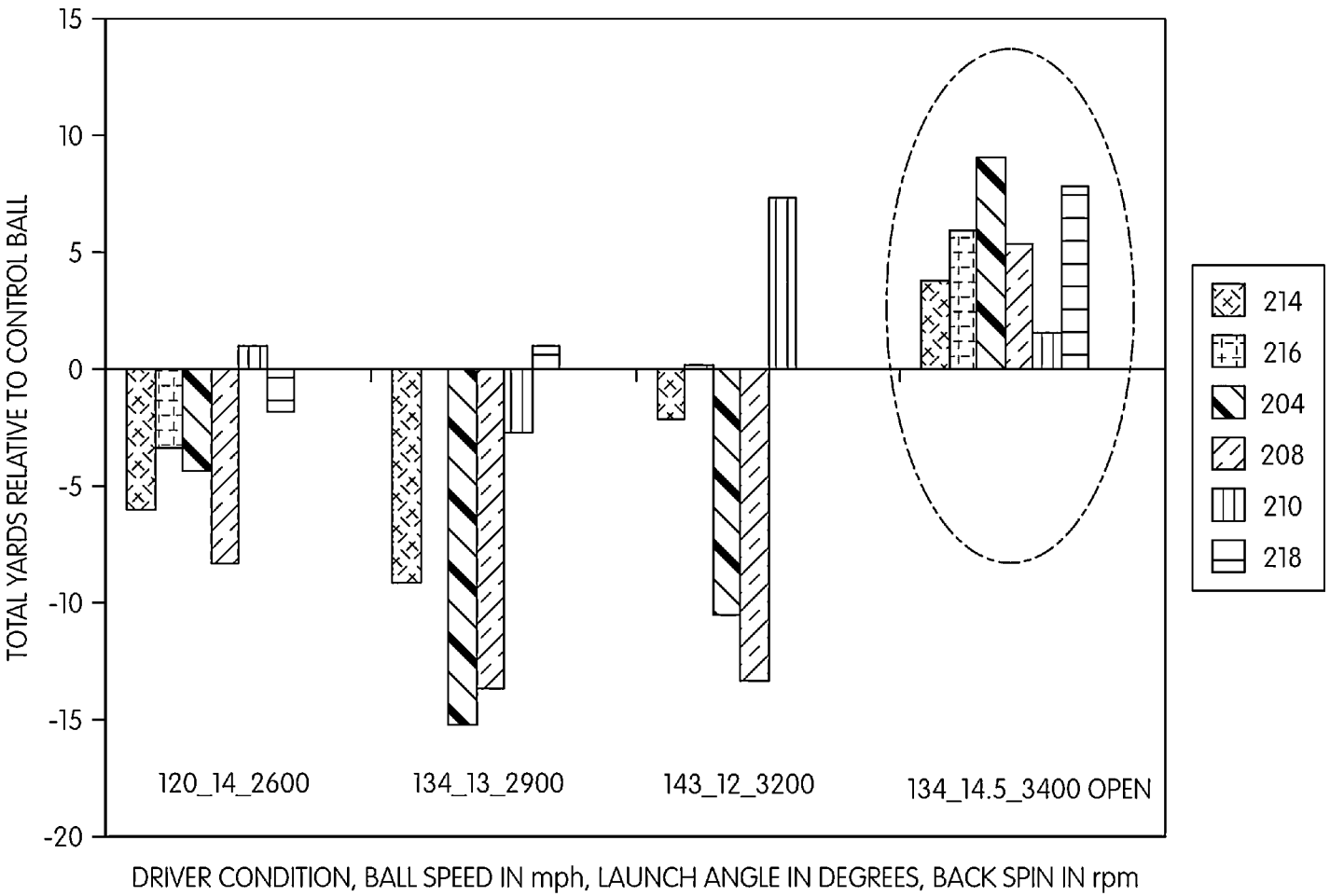
FIG. 19 is a graph showing a second set of test results when measuring total yards of multiple test balls relative to a control ball under multiple driver conditions, where some of the test balls include a composite material layer with oriented particles.

FIGS. 18 and 19 show two tests of total distance in yards achieved by third test ball 204, sixth test ball 210, eighth test ball 214, ninth test ball 216, tenth test ball 218 (FIG. 19 only), and eleventh test ball 220 (FIG. 18 only) relative to a control ball, seventh test ball 212 under various driver conditions. In the first test, ninth test ball 216 travels further than eighth test ball 214 in all but one (1) of the driver conditions. In the second test, shown in FIG. 19, ninth test ball 216 travels further than eighth test ball 214 in all three (3) of the driver conditions in which both balls were tested. This data suggests that the composite coating can increase total distance.

Figure 20:
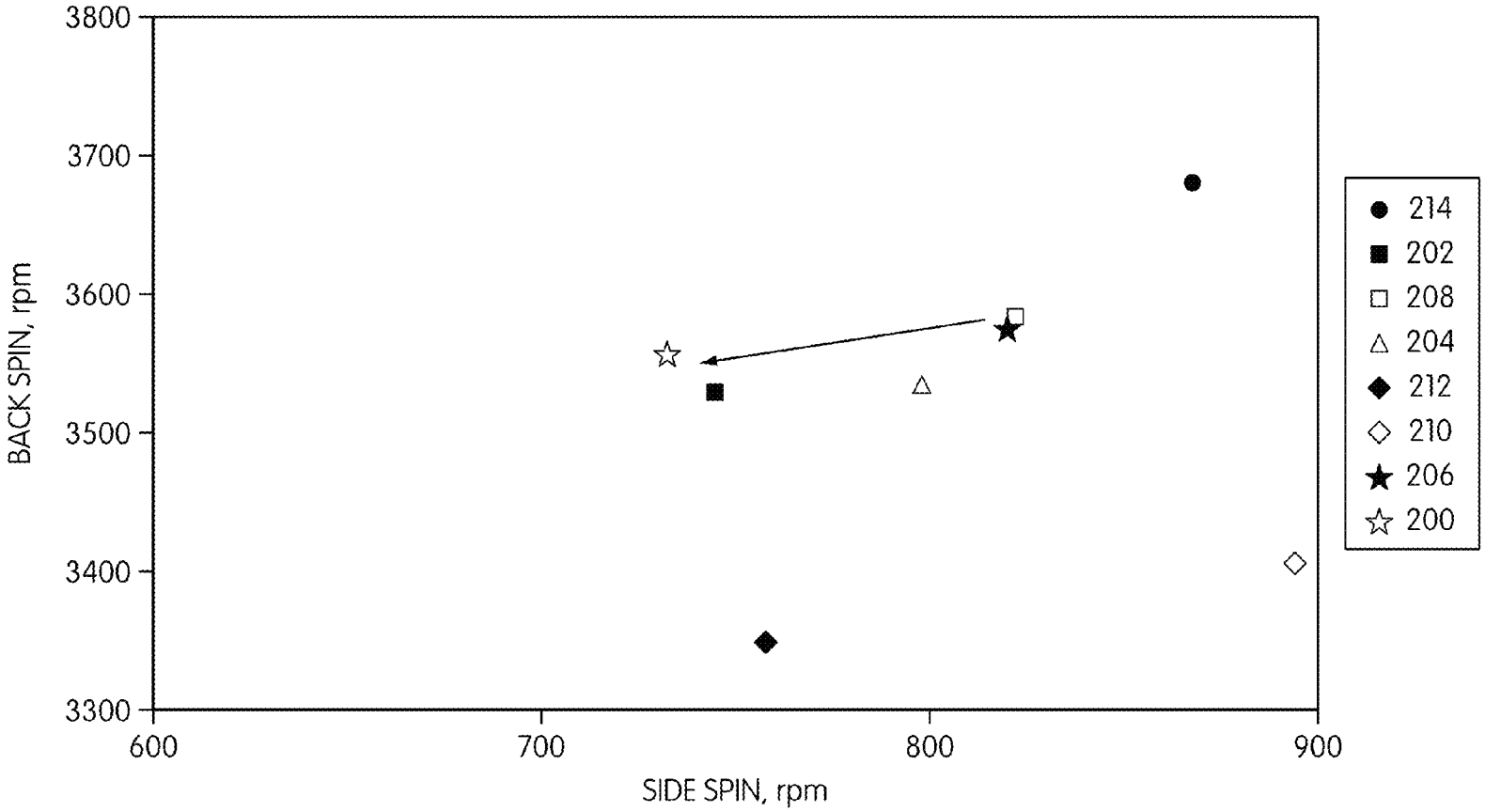
FIG. 20 is a graph showing back spin in rpm versus side spin in rpm for multiple test balls, where some of the balls include a composite material layer with oriented particles.

FIG. 20 shows back spin measured in rpm versus side spin measured in rpm for first test ball 200, second test ball 202, third test ball 204, fourth test ball 206, fifth test ball 208, sixth test ball 210, seventh test ball 212, and eighth test ball 214 when hit under a specific driver condition. Of the balls tested, first test ball 200, second test ball 202, third test ball 204, fourth test ball 206 have composite coatings with shaped and oriented particles. Fifth test ball 208 has the same construction as first test ball 200, second test ball 202, third test ball 204, fourth test ball 206 but lacks the composite coating with shaped and oriented particles. Notably, fifth test ball 208 has higher back spin and side spin than first test ball 200, second test ball 202, third test ball 204, fourth test ball 206. This data suggests that the composite coating with shaped and oriented particles can reduce both back and side spin.

Figure 21:
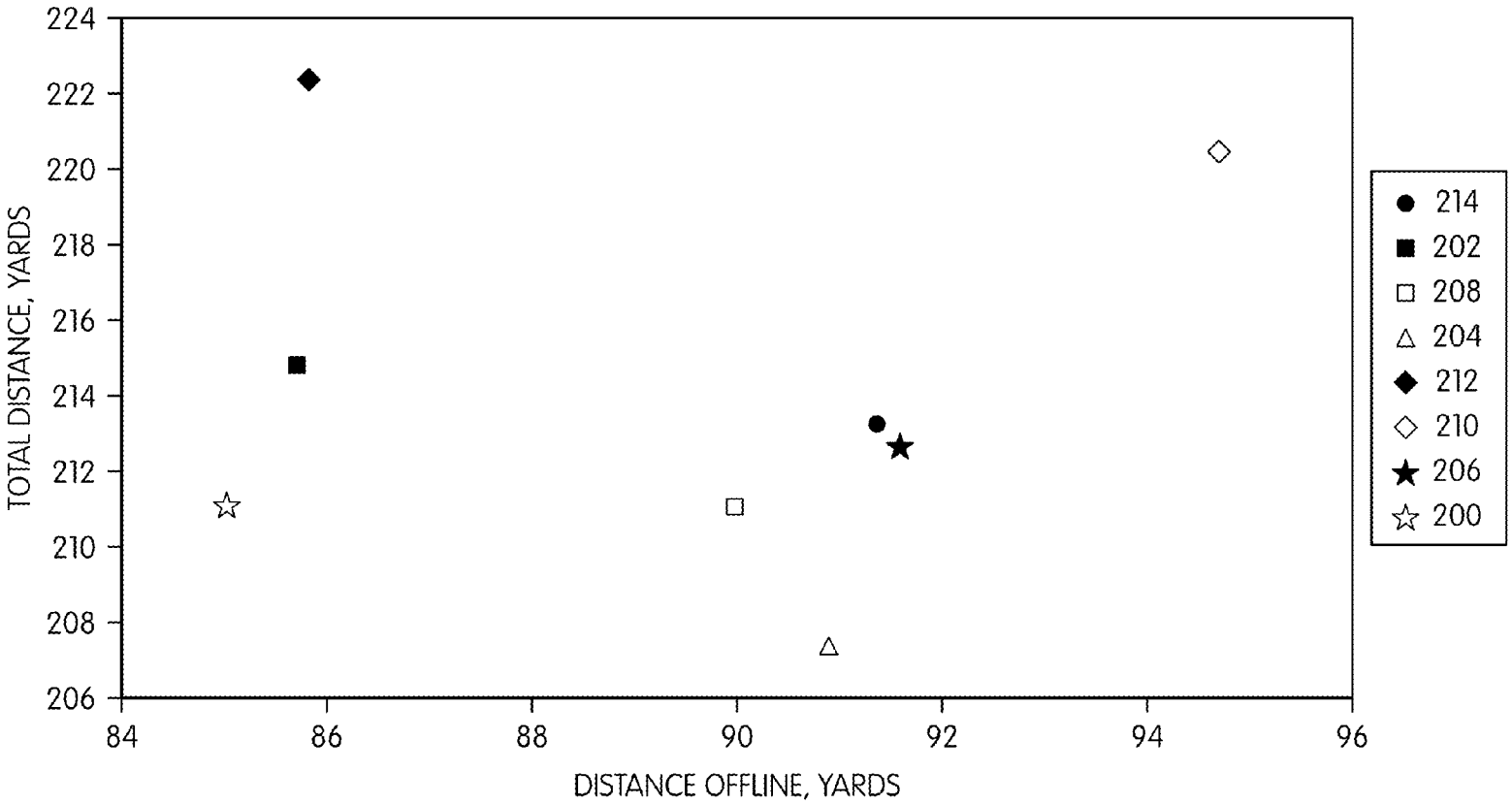
FIG. 21 is a graph showing total distance in yards versus distance offline in yards for multiple test balls, where some of the balls include a composite material layer with oriented particles.

FIG. 21 shows total distance measured in yards versus distance offline measured in yards for first test ball 200, second test ball 202, third test ball 204, fourth test ball 206, fifth test ball 208, sixth test ball 210, seventh test ball 212, and eighth test ball 214 when hit under a specific driver condition. Of the balls tested, first test ball 200, second test ball 202, third test ball 204, fourth test ball 206 have composite coatings with shaped and oriented particles. Notably, three of the four tested balls with composite coatings with shaped and oriented particles travel at least as far as fifth test ball 208, with two of those balls, first test ball 200 and second test ball 202 having significantly lower offline distances than fifth test ball 208. This data suggests that under some conditions, balls with composite coatings with shaped and oriented particles can fly straighter without loss of total distance compared to a similar ball that lacks the composite coatings with shaped and oriented particles.

Figure 22:
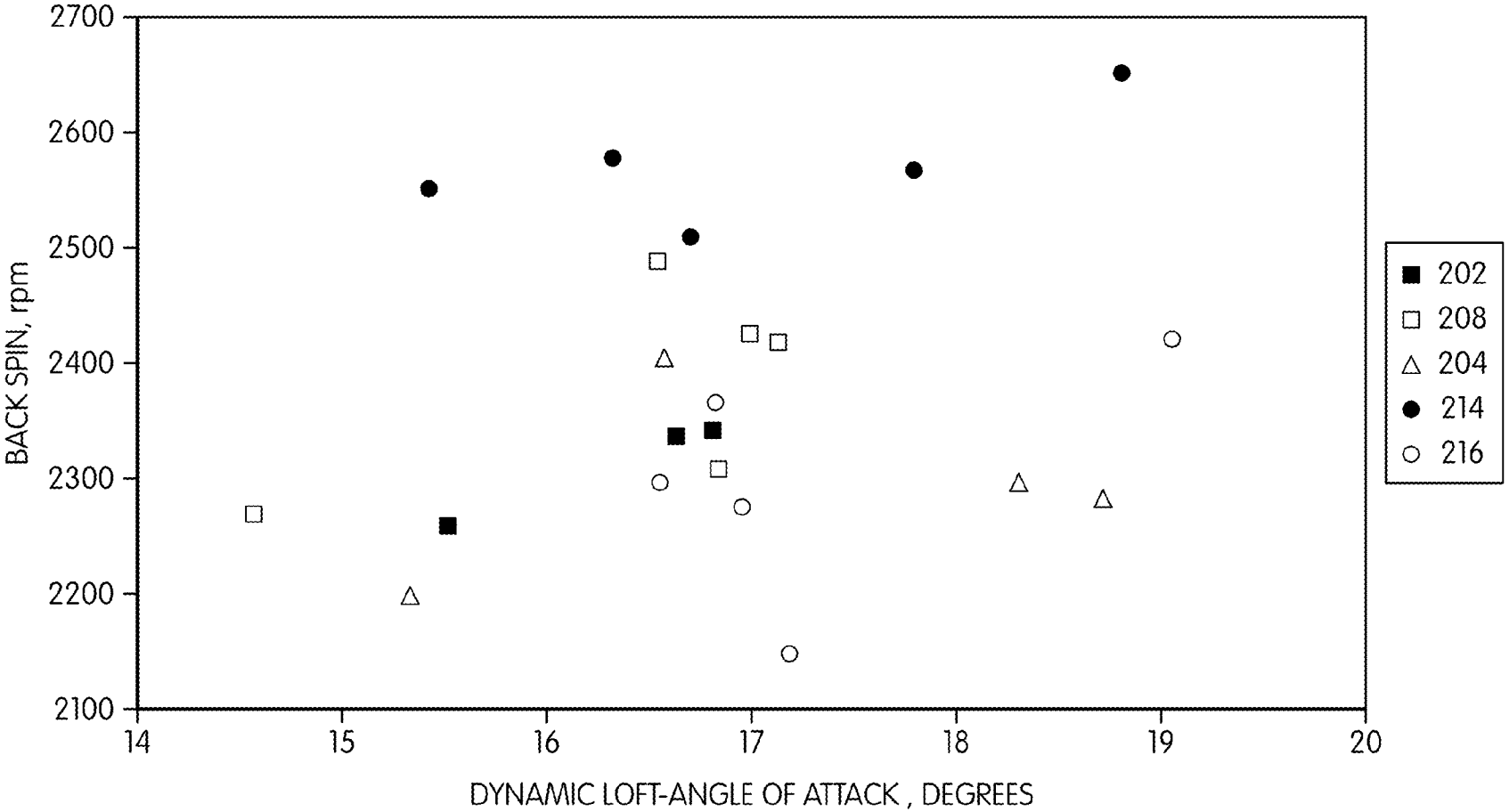
FIG. 22 is a graph showing back spin in rpm versus dynamic loft/angle of attack in degrees for multiple test balls hit by a driver, where some of the balls include a composite material layer with oriented particles.

FIG. 22 shows back spin measured in rpm versus dynamic loft angle/angle of attack measured in degrees for second test ball 202, third test ball 204, fifth test ball 208, eighth test ball 214, and ninth test ball 216 when hit by an HS driver swung at 85 mph. Of the balls tested, second test ball 202, third test ball 204, and ninth test ball 216 have composite coatings with shaped and oriented particles. Fifth test ball 208 has the same construction as second test ball 202 and third test ball 204, but lacks the composite coating with shaped and oriented particles. Notably, second test ball 202 and third test ball 204 tend to spin less than fifth test ball 208. Eighth test ball 214 has the same construction as ninth test ball 216, but lacks the composite coating with shaped and oriented particles. Ninth test ball 216 consistently spins less than eighth test ball. This data suggests that the composite coating with shaped and oriented particles can reduce back spin at various dynamic loft conditions.

Figure 23:
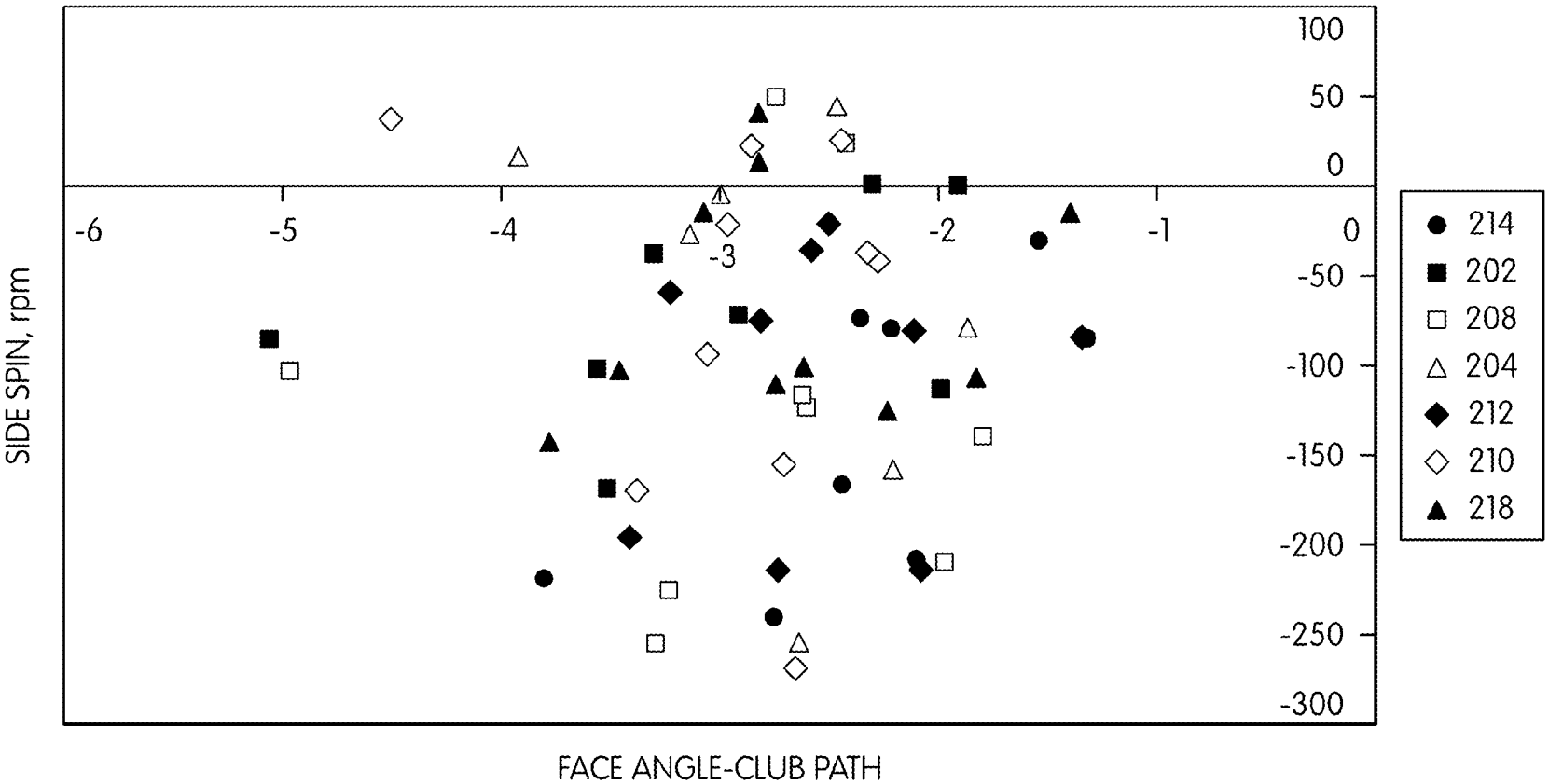
FIG. 23 is a graph showing side spin versus face angle/club path for multiple test balls, where some of the balls include a composite material layer with oriented particles.

FIG. 23 shows side spin measured in rpm versus face angle/club path for second test ball 202, third test ball 204, fifth test ball 208, sixth test ball 210, seventh test ball 212, eighth test ball 214, ninth test ball 216, and tenth test ball 218 when hit by an HS driver swung at 95 mph. Of the balls tested, second test ball 202, third test ball 204, and ninth test ball 216 have composite coatings with shaped and oriented particles. Fifth test ball 208 has the same construction as second test ball 202 and third test ball 204, but lacks the composite coating with shaped and oriented particles. Notably, second test ball 202 and third test ball 204 tend to spin less than fifth test ball 208. This data suggests that the composite coating with shaped and oriented particles can reduce side spin at various face angles.

Figure 24:
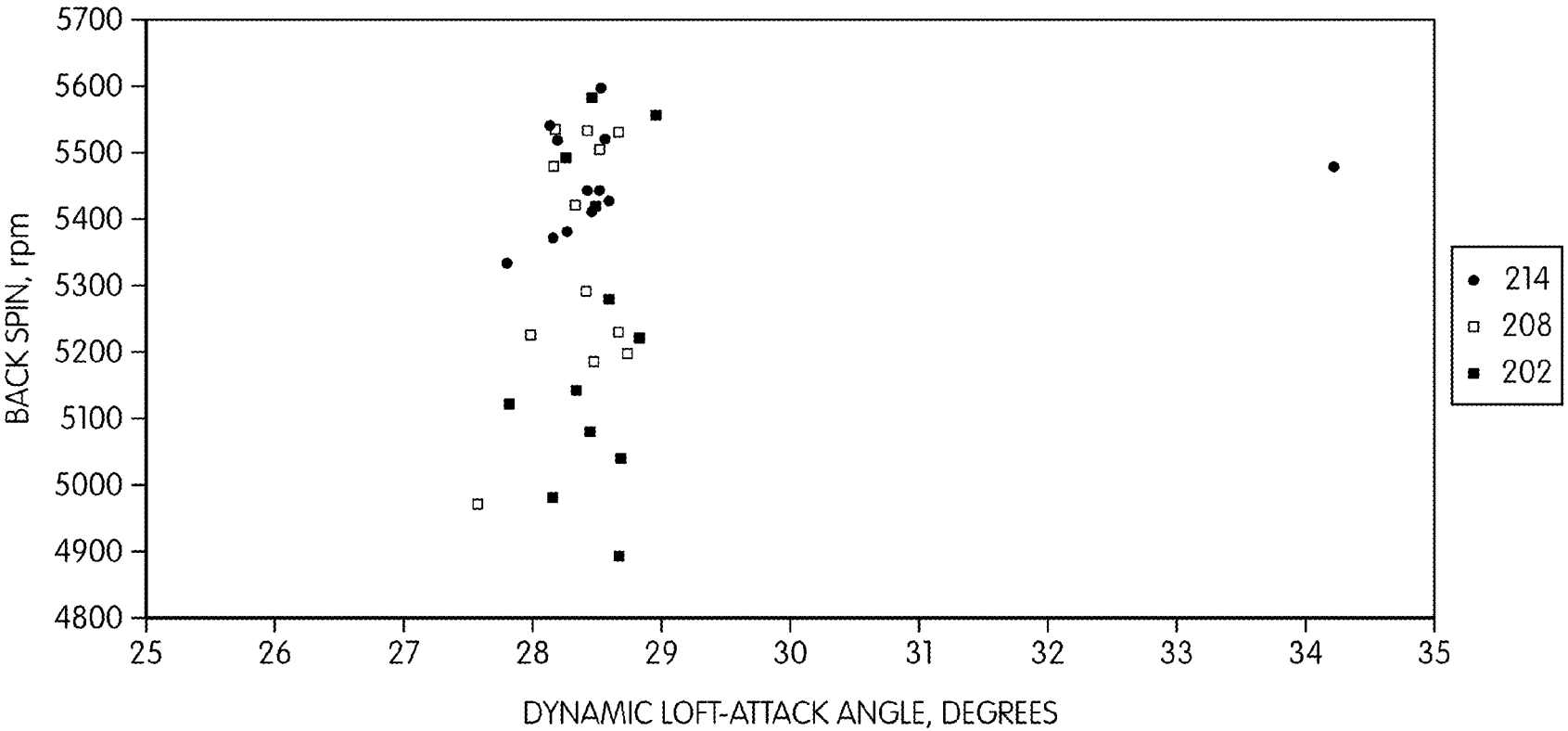
FIG. 24 is a graph showing back spin in rpm versus dynamic loft/angle of attack in degrees for multiple test balls hit by a 6 iron, where some of the balls include a composite material layer with oriented particles.

FIG. 24 shows back spin measured in rpm versus dynamic loft angle/angle of attack measured in degrees for second test ball 202, fifth test ball 208, and eighth test ball 214 when hit by a 6-iron. Fifth test ball 208 has the same construction as second test ball 202, but lacks the composite coating with shaped and oriented particles. Second test ball 202 tends to spin less than fifth test ball 208. This data suggests that the composite coating with shaped and oriented particles can reduce back spin at various dynamic loft conditions for irons as well as drivers.

Figure 25:
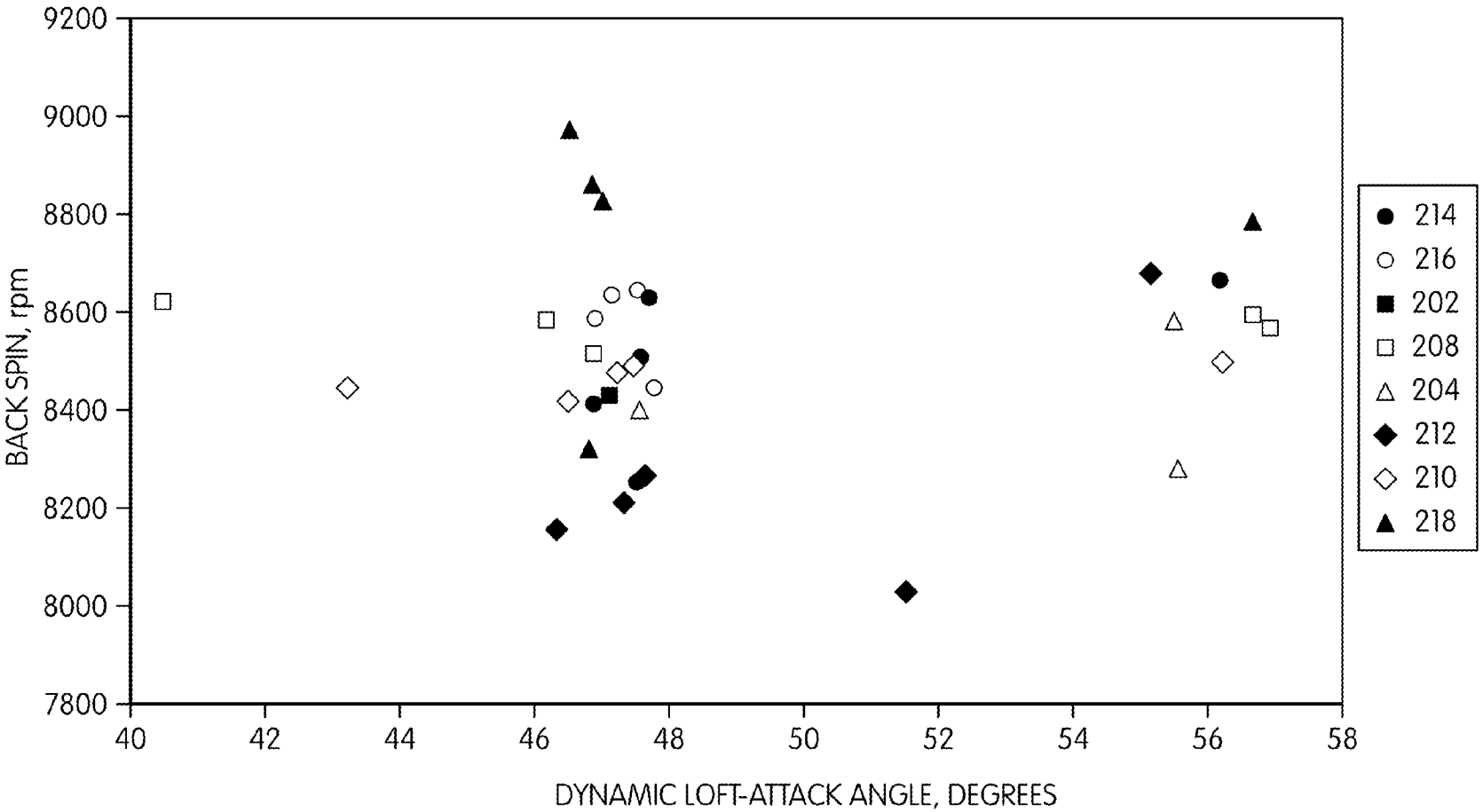
FIG. 25 is a graph showing back spin in rpm versus dynamic loft/angle of attack in degrees for multiple test balls hit by a 9 iron, where some of the balls include a composite material layer with oriented particles.

FIG. 25 shows back spin measured in rpm versus dynamic loft angle/angle of attack measured in degrees for second test ball 202, third test ball 204, fifth test ball 208, sixth test ball 210, seventh test ball 212, eighth test ball 214, ninth test ball 216, and tenth test ball 218 when hit by a 9-iron. Fifth test ball 208 has the same construction as second test ball 202 and third test ball 204, but lacks the composite coating with shaped and oriented particles. Second test ball 202 and third test ball 204 tend to spin less than fifth test ball 208. Eighth test ball 214 has the same construction as ninth test ball 216, but lacks the composite coating with shaped and oriented particles. At some loft angles, ninth test ball 216 spins less than eighth test ball 214. This data suggests that the composite coating with shaped and oriented particles can reduce back spin at various dynamic loft conditions for irons.

Figure 26:
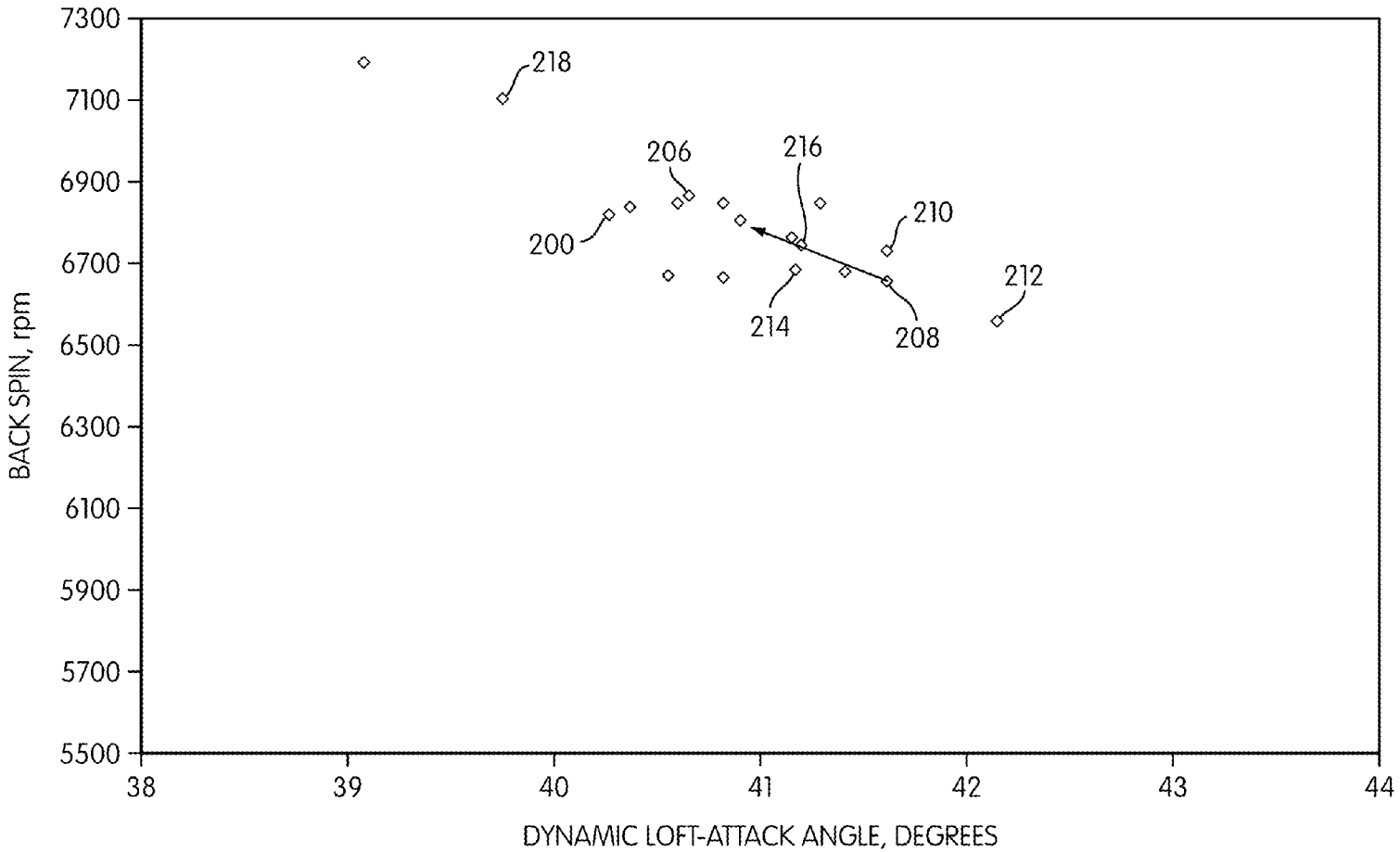
FIG. 26 is a graph showing back spin in rpm versus dynamic loft/angle of attack in degrees for multiple test balls hit by a wedge, where some of the balls include a composite material layer with oriented particles.

FIG. 26 shows back spin measured in rpm versus dynamic loft/attack angle measured in degrees for first test ball 200, second test ball 202, fourth test ball 206, fifth test ball 208, sixth test ball 210, seventh test ball 212, eighth test ball 214, ninth test ball 216, and tenth test ball 218 when hit by a wedge. Of the balls tested, first test ball 200, second test ball 202, third test ball 204, fourth test ball 206, and ninth test ball 216 have composite coatings with shaped and oriented particles. Fifth test ball 208 has the same construction as first test ball 200, second test ball 202, and fourth test ball 206, but lacks the composite coating with shaped and oriented particles. First test ball 200, second test ball 202, and fourth test ball 206 tend to spin more than fifth test ball 208. Eighth test ball 214 has the same construction as ninth test ball 216, but lacks the composite coating with shaped and oriented particles. Ninth test ball 216 spins more than eighth test ball. This data suggests that the composite coating with shaped and oriented particles can increase back spin at various dynamic loft conditions for wedges.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball comprising:

a cover;

a coating applied to the cover;

the coating comprising a first layer and a second layer;

the first layer of the coating having an outer surface, wherein a plurality of particles is at least partially embedded in the first layer, wherein each particle in the plurality of particles has an irregular peripheral shape;

wherein the second layer has an exterior surface that forms an outermost surface of the golf ball;

wherein a first group of particles in the plurality of particles is positioned within the first layer in a pre-determined orientation; and wherein a first portion of each particle in the first group of particles protrudes through the outer surface of the first layer and extends into the second layer, and wherein the first portion of each particle in the first group of particles is entirely embedded within the second layer so that no portion of any particle in the plurality of particles protrudes beyond the second layer so that a roughness of the exterior surface is not influenced by the plurality of particles.

2. The golf ball according to claim 1, wherein each particle in the plurality of particles has a shape comprising a core and at least one projection extending away from the core.

3. The golf ball according to claim 2, wherein the at least one projection comprises a filament.

4. The golf ball according to claim 3, wherein the shape comprises multiple filaments extending away from the core.

5. The golf ball according to claim 4, wherein the shape is a tetrapod.

6. The golf ball according to claim 5, wherein the first layer comprises a paint primer layer applied to an outer surface of the cover and the second layer comprises a paint layer applied to an outer surface of the primer layer, wherein at least one filament extends out of the primer layer and into the paint layer.

7. A golf ball comprising:

a first layer;

a second layer applied to the first layer, wherein the second layer has an exterior surface;

wherein the first layer includes a plurality of particles at least partially embedded within the first layer, wherein each particle in the plurality of particles has a non-uniform shape, and wherein a percentage of the plurality of particles is positioned within the layer of particles in a pre-determined orientation;

wherein at least one particle in the plurality of particles of the first layer extends from the first layer into the second layer so that the at least one particle is completely embedded within the first layer and the second layer so that the at least one particle does not protrude beyond the second layer and, wherein each particle in the plurality of particles is spaced apart from a surface of the second layer so that a roughness of the surface of the second layer is unaffected by any particle in the plurality of particles.

8. The golf ball according to claim 7, wherein the first layer comprises a core layer and the second layer comprises a cover layer.

9. The golf ball according to claim 7, wherein the first layer is a composite material layer on a core and the second layer comprises a cover layer.

10. The golf ball according to claim 7, wherein the first layer comprises a mantle layer and the second layer comprises a cover layer.

11. The golf ball according to claim 7, wherein the first layer comprises a composite material layer on a mantle layer and the second layer comprises a cover layer.

12. The golf ball according to claim 7, wherein the first layer comprises a first coating layer applied to a cover and the second layer comprises a second coating layer applied to the first layer.

13. The golf ball according to claim 12, wherein the first coating layer comprises a paint primer layer and the second coating layer comprises a paint layer.

14. The golf ball according to claim 12, wherein the non-uniform shape of the particle comprises a core and at least one projection extending away from the core.

15. The golf ball according to claim 14, wherein the non-uniform shape of the particle comprises the core and at least two projections extending away from the core.

16. The golf ball according to claim 12, wherein the non-uniform shape of the particle comprises a tetrapod.

17. The golf ball according to claim 7, wherein the concentration of particles within the first layer is between 1 PPH and 20 PPH.

* * * * *